US010712697B2

(12) United States Patent
Maeda et al.

(10) Patent No.: US 10,712,697 B2
(45) Date of Patent: Jul. 14, 2020

(54) ENDLESS SHAPED FIXING BELT AND HEAT FIXING DEVICE HAVING ENDLESS BELT SHAPE HEATING MEMBER

(71) Applicant: CANON KABUSHIKI KAISHA, Tokyo (JP)

(72) Inventors: Matsutaka Maeda, Kawasaki (JP); Yuji Kitano, Tokyo (JP); Mamo Matsumoto, Hiratsuka (JP); Katsuhisa Matsunaka, Inagi (JP); Yasuharu Notoya, Tokyo (JP); Yo Imaizumi, Tokyo (JP); Takuji Oishi, Kawasaki (JP); Yasuhiro Miyahara, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/425,104

(22) Filed: May 29, 2019

(65) Prior Publication Data

US 2019/0377291 A1 Dec. 12, 2019

(30) Foreign Application Priority Data

Jun. 7, 2018 (JP) ..... 2018-109671

(51) Int. Cl.
*G03G 15/20* (2006.01)

(52) U.S. Cl.
CPC ..... *G03G 15/2057* (2013.01); *G03G 15/2064* (2013.01); *G03G 15/206* (2013.01);
(Continued)

(58) Field of Classification Search
CPC ..... G03G 15/2057; G03G 15/2064; G03G 2215/2038; G03G 15/206; G03G 2215/2048; G03G 2215/2054
See application file for complete search history.

(56) References Cited

U.S. PATENT DOCUMENTS 8,005,413 B2 8/2011 Sakakibara et al.
8,224,223 B2 7/2012 Sakakibara et al.
(Continued)

FOREIGN PATENT DOCUMENTS

JP 2005-300591 A 10/2005
JP 2008-165024 A 7/2008
(Continued)

OTHER PUBLICATIONS

Extended European Search Report in European Application No. 19178313.3 (dated Nov. 18, 2019).
(Continued)

*Primary Examiner* — Walter L Lindsay, Jr.
*Assistant Examiner* — Laura Roth
(74) *Attorney, Agent, or Firm* — Venable LLP

(57) ABSTRACT

Provided is a fixing member includes: a substrate; and an elastic layer on the substrate, wherein the elastic layer contains a rubber and fillers dispersed in the rubber, and wherein an average value of area ratios of large-particle diameter fillers is 20% or more and 40% or less, and the large-particle diameter fillers have an average array degree $f_L$ of 0.00 or more and 0.15 or less, an average value of an area ratios of small-particle diameter fillers is 10% or more and 20% or less, the small-particle diameter fillers have an average array degree $f_S$ of 0.20 or more and 0.50 or less, and the small-particle diameter fillers have an average array angle $\Phi_S$ of 60° or more and 120° or less.

11 Claims, 9 Drawing Sheets

(52) U.S. Cl.
CPC ..... *G03G 2215/2038* (2013.01); *G03G 2215/2048* (2013.01); *G03G 2215/2054* (2013.01)

(56) References Cited

U.S. PATENT DOCUMENTS

| | | | |
|---|---|---|---|
| 8,369,763 | B2 | 2/2013 | Sakakibara et al. |
| 8,626,046 | B2 | 1/2014 | Sekihara et al. |
| 9,086,664 | B2 | 7/2015 | Matsunaka et al. |
| 9,134,663 | B2 | 9/2015 | Matsunaka et al. |
| 9,268,273 | B2 | 2/2016 | Miyahara et al. |
| 9,335,690 | B2 | 5/2016 | Asaka et al. |
| 9,367,009 | B2 | 6/2016 | Akiyama et al. |
| 10,228,644 | B2 | 3/2019 | Abe et al. |

FOREIGN PATENT DOCUMENTS

| | | | |
|---|---|---|---|
| JP | 2013-159748 | A | 8/2013 |
| JP | 2015-121650 | A | 7/2015 |

OTHER PUBLICATIONS

Written Opinion with Search Report in Singapore Application No. 10201904951V (dated Mar. 3, 2020).
M. Li et al., "Comparison of Particle Size Distributions Measured Using Different Techniques," 23(3) Part. Sci. Technol. 265-284 (2005).
Particle Shape Analysis, pp. 1-10 (https://www.sympatec.com/en/particle-measurement/glossary/particle-shape/) (2019).

ENDLESS SHAPED FIXING BELT AND HEAT FIXING DEVICE HAVING ENDLESS BELT SHAPE HEATING MEMBER

The present disclosure relates to a fixing member to be used in a heat fixing device of an electrophotographic image forming apparatus, and to a heat fixing device.

DESCRIPTION OF THE RELATED ART

In the heat fixing device of an electrophotographic image forming apparatus, a press-contact portion includes a heating member and a pressurizing member arranged to face the heating member. When a recording material holding an unfixed toner image is introduced into the press-contact portion, unfixed toner is heated and pressurized, and the toner is melted to fix the image onto the recording material. The heating member is a member with which the unfixed toner image on the recording material is in contact, and the pressurizing member is a member arranged to face the heating member. A fixing member according to the present disclosure includes a heating member and a pressurizing member. The fixing member is, for example, a rotatable fixing member having a roller shape or an endless belt shape. A fixing member including, on a substrate formed of a metal, a heat-resistant resin, or the like, an elastic layer containing a rubber, such as a crosslinked silicone rubber, and a filler has been used as such fixing member.

In recent years, a further improvement in thermal conductivity of the elastic layer of the fixing member in its thickness direction has been required for the purposes of, for example, increasing a print speed and improving image quality.

In Japanese Patent Application Laid-Open No. 2005-300591, there is a disclosure of a fixing member in which a blend of large-particle diameter fillers and small-particle diameter fillers is used as heat conductive fillers to be incorporated into an elastic layer to improve the thermal conductivity of the elastic layer while suppressing an increase in hardness of the elastic layer. In addition, in Japanese Patent Application Laid-Open No. 2013-159748, there is a disclosure of a resin composition formed by filling heat conductive inorganic spherical microfillers of a microparticle size in a synthetic resin, the resin composition being formed as described below. Part of the spherical microfillers are replaced with plate-shaped, rod-shaped, fibrous, or scale-shaped microfillers and then filled in the resin, and heat conductive inorganic nanofillers of a nanoparticle size are filled therein. In addition, an electric field is used to arrange the fillers in the direction in which the electric field is applied.

SUMMARY

One embodiment of the present disclosure is directed to providing a fixing member having high thermal conductivity in its thickness direction and having a low hardness. Another embodiment of the present disclosure is directed to providing a heat fixing device that can form a high-quality electrophotographic image.

According to one aspect of the present disclosure, there is provided a fixing member of an electrophotographic image forming apparatus including: a substrate; and an elastic layer on the substrate, the elastic layer containing a rubber and fillers dispersed in the rubber, wherein, assuming that five of binarized images each of which has a size of 150 μm×100 μm on any positions of a first section in thickness-peripheral directions of the elastic layer, and five of binarized images each of which has a size of 150 μm×100 μm on any positions of a second section in thickness-axial directions of the elastic layer are obtained, in each of the binarized images, the fillers are represented as white, and the rubber is represented as black, among the fillers in the binarized images, fillers having a circle-equivalent diameter of 5 μm or more are defined as large-particle diameter fillers, and fillers having a circle-equivalent diameter of less than 5 μm is defined as small-particle diameter fillers, and assuming that area ratios (%) of which a total areas of the large-particle diameter fillers with respect to the respective binarized images' areas are calculated, and area ratios (%) of which a total areas of the small-particle diameter fillers with respect to the respective binarized images' areas are calculated, an average value of the area ratios of the large-particle diameter fillers is 20% or more and 40% or less, and the large-particle diameter fillers have an average array degree $f_L$ of 0.00 or more and 0.15 or less, an average value of the area ratios of the small-particle diameter fillers is 10% or more and 20% or less, the small-particle diameter fillers have an average array degree $f_S$ of 0.20 or more and 0.50 or less, and the small-particle diameter fillers have an average array angle $\Phi_S$ of 60° or more and 120° or less.

According to another aspect of the present disclosure, there is provided a heat fixing device including: a heating member; and a pressurizing member arranged to face the heating member, wherein the heating member includes the fixing member.

Further features of the present disclosure will become apparent from the following description of exemplary embodiments with reference to the attached drawings.

DESCRIPTION OF THE EMBODIMENTS

According to an investigation by the present inventors, when the thermal conductivity of the elastic layer of the fixing member according to Japanese Patent Application Laid-Open No. 2005-300591 in its thickness direction is set to more than 1.5 W/(m·K), the blending amount of the filler with respect to a silicone rubber has needed to be set to 60 vol % or more. Accordingly, it may be difficult for the invention according to Japanese Patent Application Laid-Open No. 2005-300591 to provide a fixing member that has achieved a further improvement in thermal conductivity of its elastic layer while suppressing an increase in hardness thereof.

Figure 1:
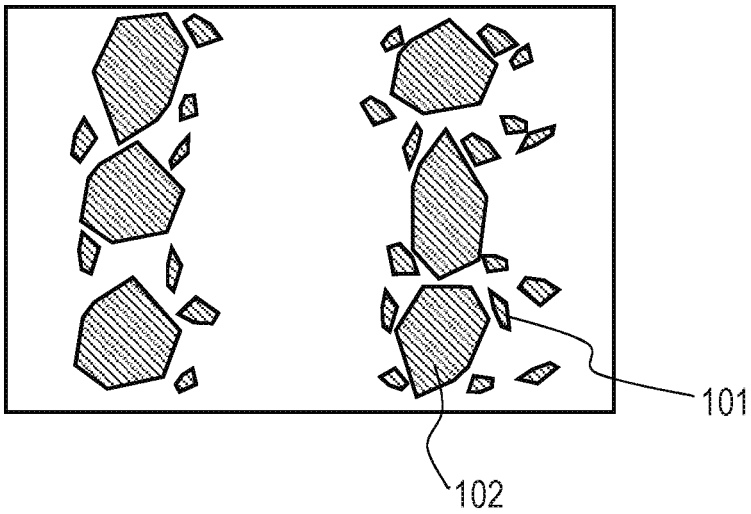
FIG. 1 is an explanatory view of the arrayed state of fillers in an elastic layer by a technology according to Japanese Patent Application Laid-Open No. 2013-159748.

In addition, the present inventors have investigated the application of the resin composition according to Japanese Patent Application Laid-Open No. 2013-159748 to the elastic layer of a fixing member. As a result, a fixing member having a region in which a hardness measured on its outer surface is partially high has sometimes been obtained. The present inventors have assumed the reason why a variation in hardness measured on the outer surface occurs in the fixing member including the elastic layer to which the resin composition according to Japanese Patent Application Laid-Open No. 2013-159748 is applied to be as described below. That is, in Japanese Patent Application Laid-Open No. 2013-159748, the resin composition is sandwiched between two electrodes, and an AC voltage is applied between the electrodes to arrange the fillers in the direction in which the electric field is applied. According to such method, as illustrated in FIG. 1, heat conductive inorganic spherical microfillers 102 are arrayed in the thickness direction of the resin composition together with heat conductive inorganic nanofillers 101 in the resin composition, and the state of presence of the heat conductive inorganic nanofillers 101 and the heat conductive inorganic spherical microfillers 102 may be sparse or dense. Thus, the hardness increases in a portion where the fillers are arranged, and the hardness reduces in a portion where the state of presence of the fillers is sparse. Hardness unevenness may occur as a result of the foregoing.

The present inventors have made investigations with a view to further improving the thermal conductivity of the elastic layer in its thickness direction while suppressing an increase in hardness of the elastic layer. As a result, the inventors have found that the object can be satisfactorily achieved by bringing the arrayed state of heat conductive fillers in the elastic layer into a specific state.

A fixing member according to one aspect of the present disclosure is a fixing member for an electrophotographic image forming apparatus including: a substrate; and an elastic layer on the substrate, in which the elastic layer contains a rubber and fillers dispersed in the rubber, and in which, in a first binarized image of a first section in the thickness-peripheral directions of the elastic layer and a second binarized image of a second section in the thickness-axial directions of the elastic layer, the average area ratio of large-particle diameter fillers each having a circle-equivalent diameter of 5 μm or more out of the fillers is 20% or more and 40% or less, and the large-particle diameter fillers have an average array degree $f_L$ of 0.00 or more and 0.15 or less, and the average area ratio of small-particle diameter fillers each having a circle-equivalent diameter of less than 5 μm out of the fillers is 10% or more and 20% or less, the small-particle diameter fillers have an average array degree $f_S$ of 0.20 or more and 0.50 or less, and the small-particle diameter fillers have an average array angle $\Phi_S$ of 60° or more and 120° or less.

Figure 9:
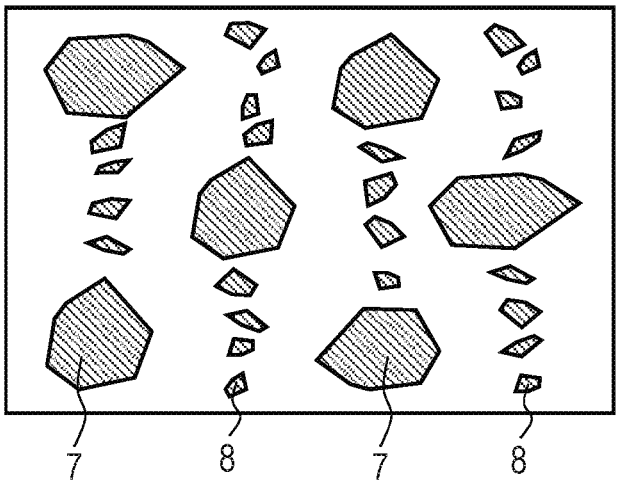
FIG. 9 is an explanatory view of the arrayed state of heat conductive fillers in the elastic layer of a fixing member according to one aspect of the present disclosure.

As illustrated in FIG. 9, the degree to which large-particle diameter fillers 7 each having a circle-equivalent diameter of 5 μm or more out of the heat conductive fillers in the elastic layer are arrayed in the thickness direction of the elastic layer is extremely low. Meanwhile, small-particle diameter fillers 8 each having a circle-equivalent diameter of less than 5 μm are arrayed in the thickness direction of the elastic layer to a high degree. Thus, both an improvement in thermal conductivity of the elastic layer in the thickness direction and a low hardness thereof can be achieved. In each of FIG. 1 and FIG. 9, a vertical direction in the figure is the thickness direction of the elastic layer.

Available as a method of improving the thermal conductivity in the thickness direction without increasing the amount of the heat conductive fillers to be blended into the elastic layer is a technology involving arraying the fillers with an external field, such as a force field, a magnetic field, or an electric field. Inorganic oxides, such as alumina, silica, zinc oxide, and magnesium oxide, are often generally used as the heat conductive fillers to be blended into the elastic layer of the fixing member, and each have a high affinity for array with an electric field using dielectric polarization as a driving force. In the technology disclosed in Japanese Patent Application Laid-Open No. 2013-159748 involving arranging the fillers with an electric field, a curable liquid having dispersed therein the heat conductive fillers is sandwiched between parallel flat plate electrodes, and an alternating electric field is applied to the liquid for from several tens of minutes to several hours, and at the same time, the liquid is cured with heat or the like. Thus, the fillers are subjected to dielectrophoresis to provide a cured product in which the fillers are arranged in a direction between the electrodes. In such method as described above, however, a large filler that has been blended may be arranged in the thickness direction as illustrated in FIG. 1 to cause an increase in hardness or hardness unevenness.

Meanwhile, in this embodiment, while the array of the large-particle diameter fillers in the thickness direction is suppressed, the small-particle diameter fillers are arrayed between the large-particle diameter fillers to a high degree, and a space between the large-particle diameter fillers is bridged with the group of small-particle diameter fillers to form a heat conductive path. Thus, the thermal conductivity is improved. Accordingly, a further improvement in thermal conductivity can be achieved while an increase in hardness is suppressed.

The elastic layer of the fixing member may be produced by, for example, such a method as described below. The layer of a composition for forming an elastic layer containing the heat conductive fillers and raw materials for a binder (hereinafter sometimes referred to as "composition layer") is formed on the substrate. Before the composition layer is heated and cured, the outer surface of the composition layer is charged. Thus, the small-particle diameter fillers each having a circle-equivalent diameter of less than 5 μm out of the heat conductive fillers in the composition layer are arrayed in the thickness direction of the composition layer. Meanwhile, the large-particle diameter fillers each having a circle-equivalent diameter of 5 μm or more out of the heat conductive fillers in the composition layer are substantially free from being arrayed. After that, the composition layer is heated and cured to form the elastic layer according to this aspect. In the elastic layer thus obtained, the thermal conductivity of the elastic layer in its thickness direction can be further improved while an increase in hardness of the elastic layer is suppressed.

A non-contact system is preferred as a method of charging the outer surface of the composition layer, and a corona charger that can perform substantially uniform charging simply and inexpensively is more preferred.

The reason why, when the outer surface of the composition layer is charged, the arrangement of the large-particle diameter fillers in the composition layer is suppressed, and the small-particle diameter fillers are arrayed to a high degree is described below. That is, in the method, a force enough to subject the large-particle diameter fillers to dielectrophoresis may not be exhibited. However, when the surface of the composition layer is charged, dielectric polarization occurs in the large-particle diameter fillers, and hence a local electric field may be formed between the large-particle diameter fillers. As a result, the small-particle diameter fillers present between the large-particle diameter fillers may be arrayed between the large-particle diameter fillers by the local electric field to a high degree to form a heat conductive path connecting the large-particle diameter fillers.

A fixing member and a heat fixing device according to embodiments of the present disclosure are described in detail below based on specific constructions.

(1) Outline of Construction of Fixing Member

Details about the fixing member of this embodiment are described with reference to the drawings.

The fixing member according to one aspect of the present disclosure may be turned into, for example, a rotatable member having a roller shape or an endless belt shape (hereinafter sometimes referred to as "fixing roller" and "fixing belt", respectively).

Figure 2B:
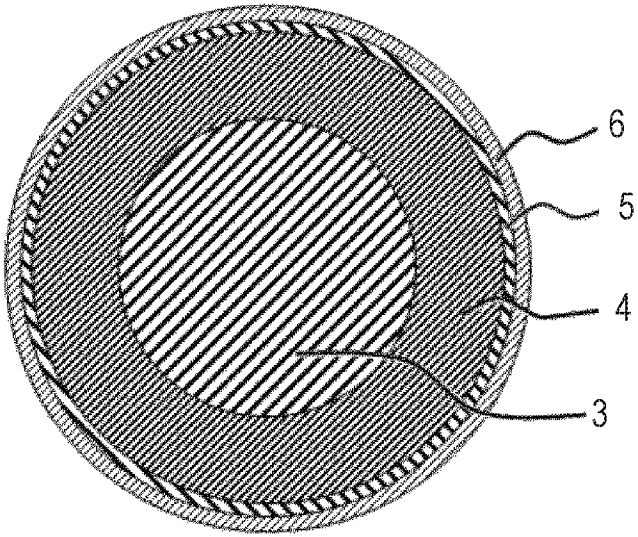
FIG. 2B is a schematic sectional view of a fixing roller according to two aspects of the present disclosure.
Figure 2A:
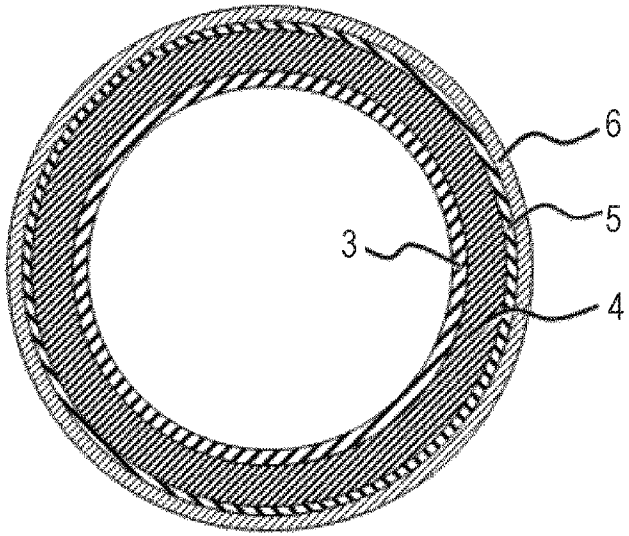
FIG. 2A is a schematic sectional view of a fixing belt according to two aspects of the present disclosure.

FIG. 2A is a sectional view in the peripheral direction of the fixing belt, and FIG. 2B is a sectional view in the peripheral direction of the fixing roller. As illustrated in each of FIG. 2A and FIG. 2B, the fixing member includes a substrate 3 and an elastic layer 4 on the outer surface of the substrate 3. In addition, the member may include a surface layer (release layer) 6 on the outer surface of the elastic layer 4. Further, the member may include an adhesion layer 5 between the elastic layer 4 and the surface layer 6, and in this case, the surface layer 6 is fixed to the outer peripheral surface of the elastic layer 4 by the adhesion layer 5.

(2) Substrate

A material for the substrate is not particularly limited, and a known material in the field of the fixing member may be appropriately used. Examples of the material for forming the substrate include: metals, such as aluminum, iron, nickel, and copper; alloys, such as stainless steel; and resins, such as polyimide.

Herein, when the heat fixing device is a heat fixing device in which the substrate is heated by using an induction heating system as a method of heating the fixing member, the substrate includes at least one kind of metal selected from the group consisting of nickel, copper, iron, and aluminum. An alloy using nickel or iron out of those metals as a main component is particularly suitably used from the viewpoint of heat generation efficiency. The term "main component" as used herein means a component that is incorporated in the largest amount out of the components forming an object (the substrate in this case).

The shape of the substrate may be appropriately selected in accordance with the shape of the fixing member, and the substrate may be formed into various shapes, such as an endless belt shape, a hollow cylindrical shape, a solid columnar shape, and a film shape.

In the case of the fixing belt, the thickness of the substrate is preferably set to, for example, from 15 μm to 80 μm. When the thickness of the substrate is set within the range, both the strength and flexibility of the belt may be achieved at high levels. In addition, on the surface of the substrate on a side opposite to a side facing the elastic layer, for example, a layer for preventing the wear of the inner peripheral surface of the fixing belt in the case where the inner peripheral surface of the fixing belt is in contact with any other member, or a layer for improving slidability with the other member may be arranged.

The surface of the substrate on the side facing the elastic layer may be subjected to a surface treatment for imparting a function, such as an adhesive property with the elastic layer. Examples of the surface treatment include: physical treatments, such as a blasting treatment, a lapping treatment, and polishing; and chemical treatments, such as an oxidation treatment, a coupling agent treatment, and a primer treatment. In addition, a physical treatment and a chemical treatment may be used in combination.

In particular, when an elastic layer containing a crosslinked silicone rubber as a binder is used, the outer surface of the substrate is preferably treated with a primer for improving adhesiveness between the substrate and the elastic layer. For example, a primer in a paint state obtained by appropriately blending and dispersing an additive in an organic solvent may be used as the primer. Such primer is commercially available. Examples of the additive may include silane coupling agents, silicone polymers, hydrogenated methylsiloxane, alkoxysilanes, catalysts for accelerating a reaction, such as hydrolysis, condensation, or addition, and colorants, such as colcothar. The primer treatment is performed by: applying the primer to the outer surface of the substrate; and subjecting the resultant to drying and calcining processes.

The primer may be appropriately selected depending on, for example, the material for the substrate, the kind of the elastic layer, and a reaction form at the time of crosslinking. For example, when the material for forming the elastic layer contains a large amount of an unsaturated aliphatic group, a material containing a hydrosilyl group is preferably used as the primer in order that the adhesive property may be imparted by a reaction with the unsaturated aliphatic group. In addition, when the material for forming the elastic layer contains a large amount of a hydrosilyl group, in contrast, a material containing an unsaturated aliphatic group is preferably used as the primer. Any other material except the foregoing such as a material containing an alkoxy group may be appropriately selected as the primer depending on the kinds of the substrate and the elastic layer serving as adherends.

(3) Elastic Layer

The elastic layer is a layer for imparting softness to the fixing member for securing a fixing nip in the heat fixing device. When the fixing member is used as a heating member in contact with toner on paper, the elastic layer also functions as a layer for imparting such softness that the surface of the fixing member may follow the irregularities of the paper. The elastic layer contains the rubber serving as a binder and the fillers dispersed in the rubber. More specifically, the elastic layer contains the binder and the heat conductive fillers, and includes a cured product obtained by curing a composition containing at least raw materials for the binder (e.g., a base polymer and a crosslinking agent), and the heat conductive fillers.

From the viewpoint that the above-mentioned function of the elastic layer is expressed, the elastic layer preferably includes a silicone rubber cured product containing the heat conductive fillers, and more preferably includes a cured product of an addition-curable silicone rubber composition. The silicone rubber composition may contain, for example, the heat conductive fillers, the base polymer, the crosslinking agent and a catalyst, and as required, an additive. The silicone rubber composition is preferred because of the following reason: the composition is often liquid, and hence the heat conductive fillers are easily dispersed therein, and the elasticity of the elastic layer to be produced is easily adjusted by adjusting its degree of crosslinking in accordance with the kinds and addition amounts of the heat conductive fillers.

(3-1) Binder

The binder serves to express the elasticity in the elastic layer. The binder preferably contains a silicone rubber from the viewpoint that the above-mentioned function of the elastic layer is expressed. The silicone rubber is preferred because the rubber has such high heat resistance that its softness can be retained even in an environment having a temperature as high as about 240° C. in a non-paper passing portion region. For example, a cured product of an addition-curable liquid silicone rubber (hereinafter sometimes referred to as "cured silicone rubber") to be described later may be used as the silicone rubber.

(3-1-1) Addition-Curable Liquid Silicone Rubber

The addition-curable liquid silicone rubber typically includes the following components (a) to (c):

component (a): organopolysiloxane having an unsaturated aliphatic group;

component (b): organopolysiloxane having active hydrogen bonded to silicon; and component (c): catalyst.

The respective components are described below.

(3-1-2) Component (a)

The organopolysiloxane having an unsaturated aliphatic group is an organopolysiloxane having an unsaturated aliphatic group, such as a vinyl group, and examples thereof include organopolysiloxanes represented by the following structural formula 1 and structural formula 2.

Structural formula 1

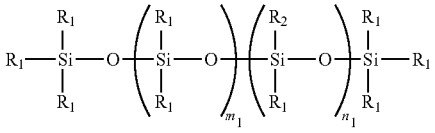

In the structural formula 1, $m_1$ represents an integer of 0 or more, and $n_1$ represents an integer of 3 or more. In addition, in the structural formula 1, $R_{1S}$ each independently represent a monovalent unsubstituted or substituted hydrocarbon group free of any unsaturated aliphatic group, provided that at least one of $R_{1S}$ represents a methyl group, and $R_{2S}$ each independently represent an unsaturated aliphatic group.

Structural formula 2

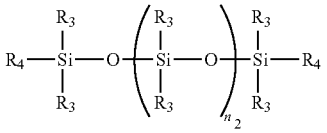

In the structural formula 2, $n_2$ represents a positive integer, $R_{3S}$ each independently represent a monovalent unsubstituted or substituted hydrocarbon group free of any unsaturated aliphatic group, provided that at least one of $R_{3S}$ represents a methyl group, and $R_{4S}$ each independently represent an unsaturated aliphatic group.

In the structural formula 1 and the structural formula 2, examples of the monovalent unsubstituted or substituted hydrocarbon group free of any unsaturated aliphatic group that may be represented by any one of $R_{1S}$ and $R_{3S}$ may include the following groups.

Unsubstituted Hydrocarbon Group

Alkyl groups (e.g., a methyl group, an ethyl group, a propyl group, a butyl group, a pentyl group, and a hexyl group)

Aryl groups (e.g., a phenyl group)

Substituted Hydrocarbon Group

Alkyl groups (e.g., substituted alkyl groups, such as a chloromethyl group, a 3-chloropropyl group, a 3,3,3-trifluoropropyl group, a 3-cyanopropyl group, and a 3-methoxypropyl group).

The organopolysiloxanes represented by the structural formula 1 and the structural formula 2 each have at least one methyl group directly bonded to a silicon atom forming a chain structure. However, 50% or more of each of $R_{1S}$ and $R_{3S}$ preferably represent methyl groups because such organopolysiloxane is easily synthesized and handled, and all of $R_{1S}$ and $R_{3S}$ more preferably represent methyl groups.

In addition, in the structural formula 1 and the structural formula 2, examples of the unsaturated aliphatic group that may be represented by any one of $R_{2S}$ and $R_{4S}$ may include the following groups. That is, examples of the unsaturated aliphatic group may include a vinyl group, an allyl group, a 3-butenyl group, a 4-pentenyl group, and a 5-hexenyl group. $R_{2S}$ and $R_{4S}$ each preferably represent a vinyl group out of those groups because such organopolysiloxane is easily synthesized and handled, and is available at low cost, and its crosslinking reaction is easily performed.

The viscosity of the component (a) is preferably 100 $mm^2/s$ or more and 50,000 $mm^2/s$ or less from the viewpoint of its moldability. The viscosity (kinematic viscosity) may be measured based on JIS Z 8803:2011 with a capillary viscometer, a rotational viscometer, or the like.

The blending amount of the component (a) is preferably set to 40 vol % or more with respect to the liquid silicone rubber composition to be used in the formation of the elastic layer from the viewpoint of the pressure resistance of the layer, and is preferably set to 70 vol % or less with respect thereto from the viewpoint of the heat transfer property thereof.

(3-1-3) Component (b)

The organopolysiloxane having active hydrogen bonded to silicon functions as a crosslinking agent that reacts with an unsaturated aliphatic group of the component (a) by virtue of the action of the catalyst to form the cured silicone rubber.

Any organopolysiloxane may be used as the component (b) as long as the organopolysiloxane has a Si—H bond. An organopolysiloxane having an average of 3 or more hydrogen atoms bonded to a silicon atom in a molecule thereof is particularly suitably used from the viewpoint of its reactivity with an unsaturated aliphatic group of the component (a). Specific examples of the component (b) may include a linear organopolysiloxane represented by the following structural formula 3 and a cyclic organopolysiloxane represented by the following structural formula 4.

Structural formula 3

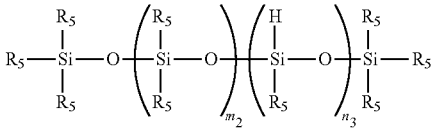

In the structural formula 3, $m_2$ represents an integer of 0 or more, $n_3$ represents an integer of 3 or more, and $R_{5S}$ each independently represent a monovalent unsubstituted or substituted hydrocarbon group free of any unsaturated aliphatic group.

Structural formula 4

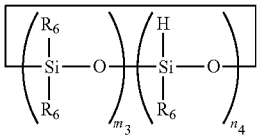

In the structural formula 4, $m_3$ represents an integer of 0 or more, $n_4$ represents an integer of 3 or more, and $R_{6S}$ each independently represent a monovalent unsubstituted or substituted hydrocarbon group free of any unsaturated aliphatic group.

Examples of the monovalent unsubstituted or substituted hydrocarbon group free of any unsaturated aliphatic group that may be represented by any one of $R_{5S}$ and $R_{6S}$ in the structural formula 3 and the structural formula 4 may include the same groups as those represented by $R_{1S}$ in the structural formula 1 described above. Fifty percent or more of each of $R_{5S}$ and $R_{6S}$ preferably represent methyl groups out of those groups because such organopolysiloxane is easily synthesized and handled, and excellent heat resistance is easily obtained, and all of $R_{5S}$ and $R_{6S}$ more preferably represent methyl groups.

(3-1-4) Component (c)

The catalyst to be used in the formation of the binder may be, for example, a hydrosilylation catalyst for accelerating a curing reaction. A known substance, such as a platinum compound or a rhodium compound, may be used as the hydrosilylation catalyst. The blending amount of the catalyst may be appropriately set and is not particularly limited.

(3-2) Heat Conductive Fillers

The heat conductive fillers are selected in consideration of, for example, the thermal conductivities, specific heat capacities, densities, particle diameters, and specific dielectric constants of the heat conductive fillers themselves. Examples of the heat conductive fillers to be used for the purpose of improving a heat transfer characteristic, such as inorganic substances, particularly a metal and a metal compound, may include silicon carbide, silicon nitride, boron nitride, aluminum nitride, alumina, zinc oxide, magnesium oxide, silica, copper, aluminum, silver, iron, nickel, metallic silicon, and carbon fiber.

Further, from the viewpoints of the thermal conductivities, electrical resistance values, and specific dielectric constants of the fillers themselves, the fillers are more preferably at least one kind of filler selected from the group consisting of alumina, zinc oxide, metallic silicon, silicon carbide, boron nitride, and magnesium oxide. In particular, magnesium oxide having a high electrical resistance value and a high specific dielectric constant is still more preferred.

The fillers may be subjected to a surface treatment from the viewpoints of their affinities for silicone and electrical resistance values. Specifically, a filler having an active group, such as a hydroxy group, on its surface, such as alumina, silica, or magnesium oxide, is subjected to a surface treatment with a silane coupling agent, hexamethyldisilazane, or the like. A metal filler is subjected to a surface treatment through the formation of an oxide film.

Further, electrical resistance value adjustment may be performed in the entirety of the silicone rubber composition. Even in the case of a filler having a relatively low electrical resistance value, when the filler is used in combination with a second filler having a high electrical resistance value, the electrical resistance value of the entirety of the composition may be adjusted.

The volume-average particle diameter of the fillers is preferably 0.1 μm or more and 100 μm or less, more preferably 0.3 μm or more and 30 μm or less.

The particle diameter of each of the large-particle diameter fillers that are prevented from being arranged, i.e. arrayed to the extent possible is 5 μm or more. Assuming that five binarized images each of which has a size of 150 μm×100 μm on any positons of a section in the thickness direction and peripheral direction (thickness-peripheral directions) of the elastic layer, and five binarized images each of which has as size of 150 μm×100 μm on any positons of a section in the thickness direction and axial direction (thickness-axial directions) of the elastic layer are obtained, and area ratios (%), i.e. percentage ratios of a total areas of the large-particle diameter fillers with respect to the respective binarized images' areas, are calculated, an average value of the obtained 10 area ratios, hereinafter referred as "average area ratio of the large-particle diameter fillers", is 20% or more and 40% or less. The average area ratio of the large-particle diameter fillers means [(sum of the areas of the large-particle diameter fillers in the binarized images×100)/(areas of the binarized images)]. When the average area ratio of the large-particle diameter fillers is less than 20%, a distance between the large-particle diameter fillers lengthens, and hence a sufficiently large local electric field cannot be generated at the time of the application of an electric field. Accordingly, it becomes difficult to sufficiently array the small-particle diameter fillers present between the large-particle diameter fillers. In addition, when the average area ratio of the large-particle diameter fillers is more than 40%, it becomes difficult to sufficiently reduce the hardness of the elastic layer.

The particle diameter of each of the small-particle diameter fillers to be arrayed is less than 5 μm. Assuming that area ratios (%), i.e. percentage ratios of a total areas of the small-particle diameter fillers with respect to the respective binazied images' areas, are calculated, an average value of the obtained 10 area ratios, hereinafter refereed as "average area ratio of the small-particle diameter fillers", is 10% or more and 20% or less. The average area ratio of the small-particle diameter fillers means [(sum of the areas of the small-particle diameter fillers in the binarized images×100)/(areas of the binarized images)]. When the average area ratio of the small-particle diameter fillers is less than 10%, it becomes difficult to array the small-particle diameter fillers to sufficiently improve the thermal conductivity of the elastic layer. In addition, when the average area ratio of the small-particle diameter fillers is more than 20%, the viscosity of a material for the elastic layer increases, and hence a problem in terms of the processability or smoothness of the elastic layer occurs in some cases.

A sum of the average area ratio of the large-particle diameter fillers and the average area ratio of the small-particle diameter fillers may preferably be 30% or more and 60% or less, more preferably be 30% or more and 50% or less. The sum of the average area ratio of the large-particle diameter fillers and the average area ratio of the small-particle diameter fillers is a value deeply related to a volume ratio of which all the fillers are occupying in the elastic layer. When the sum of the average area ratio of the large-particle diameter fillers and the average area ratio of the small-particle diameter fillers is within the aforementioned range, a more improvement in thermal conductivity of the elastic layer and more sufficient elasticity of the elastic layer can be expected.

(3-3)

The composition of the cured silicone rubber in the elastic layer may be identified by performing attenuated total reflection (ATR) measurement with an infrared spectrophotometer (FT-IR) (e.g., product name: Frontier FT IR, manufactured by PerkinElmer). A silicon-oxygen bond (Si—O) serving as the main chain structure of silicone shows strong infrared absorption around a wavenumber of 1,020 $cm^{-1}$ in association with stretching vibration. Further, a methyl group bonded to a silicon atom ($Si—CH_3$) shows strong infrared absorption around a wavenumber of 1,260 $cm^{-1}$ in association with bending vibration resulting from its structure. Accordingly, their presence can be confirmed.

The contents of the cured silicone rubber and the fillers in the elastic layer may be determined with a thermogravimetric apparatus (TGA) (e.g., product name: TGA851, manufactured by Mettler-Toledo). The elastic layer is cut out with a razor or the like, and about 20 mg thereof is precisely weighed and loaded into an alumina pan to be used in the apparatus. The alumina pan containing the sample is set in the apparatus, and under a nitrogen atmosphere, the sample is heated from room temperature to 800° C. at a rate of temperature increase of 20° C. per minute. Further, the temperature is kept constant at 800° C. for 1 hour. In the nitrogen atmosphere, along with the temperature increase, the cured silicone rubber component is decomposed and removed by cracking without being oxidized, and hence the weight of the sample reduces. Comparison between the weights before and after such measurement can determine the content of the cured silicone rubber component in the elastic layer and the content of the fillers therein.

(4) Adhesion Layer

The adhesion layer is a layer for bonding the elastic layer and the surface layer. An adhesive appropriately selected from known adhesives may be used as an adhesive to be used in the adhesion layer, and the adhesive to be used in the layer is not particularly limited. However, an addition-curable silicone rubber blended with a self-adhesive component is preferably used from the viewpoint of its ease of handling. The adhesive may contain, for example, the self-adhesive component, an organopolysiloxane having a plurality of unsaturated aliphatic groups typified by a vinyl group in its molecular chain, a hydrogen organopolysiloxane, and a platinum compound serving as a crosslinking catalyst. The adhesion layer for bonding the surface layer to the elastic layer may be formed by curing the adhesive applied to the surface of the elastic layer through an addition reaction.

Examples of the self-adhesive component may include the following:

a silane having at least one kind of functional group, preferably two or more kinds of functional groups selected from the group consisting of an alkenyl group, such as a vinyl group, a (meth)acryloxy group, a hydrosilyl group (SiH group), an epoxy group, an alkoxysilyl group, a carbonyl group, and a phenyl group;

an organic silicon compound, such as a cyclic or linear siloxane having 2 or more and 30 or less silicon atoms, preferably 4 or more and 20 or less silicon atoms; and a non-silicon-based organic compound that may contain an oxygen atom in a molecule thereof (i.e., a compound containing no silicon atom in the molecule), provided that: the compound contains, in one molecule, 1 or more and 4 or less, preferably 1 or more and 2 or less aromatic rings, such as mono- or higher valent and tetra- or lower valent, preferably di- or higher valent and tetra- or lower valent phenylene structures; and the compound contains, in one molecule, at least one, preferably 2 or more and 4 or less functional groups capable of contributing to a hydrosilylation addition reaction (e.g., an alkenyl group or a (meth) acryloxy group).

The self-adhesive components may be used alone or in combination thereof. In addition, a filler component may be added to the adhesive from the viewpoints of the adjustment of its viscosity and the securement of its heat resistance to the extent that the addition does not deviate from the gist of the present disclosure. Examples of the filler component may include the following:

silica, alumina, iron oxide, cerium oxide, cerium hydroxide, and carbon black.

The blending amount of each component to be incorporated into the adhesive is not particularly limited, and may be appropriately set. Such addition-curable silicone rubber adhesive is commercially available, and is hence easily available. The thickness of the adhesion layer is preferably 20 μm or less. When the thickness of the adhesion layer is set to 20 μm or less, at the time of the use of the fixing belt according to this aspect as a heating belt in the heat fixing device, its heat resistance can be easily set to a small value, and hence heat from the inner surface side of the belt is efficiently transferred to a recording medium with ease.

(5) Surface Layer

A fluorine resin is preferably incorporated into the surface layer that the fixing member of the present disclosure may arbitrarily include for causing the layer to express a function as a release layer configured to prevent the adhesion of toner to the outer surface of the fixing member. For example, resins given below may each be molded into a tube shape and used in the formation of the surface layer:

a tetrafluoroethylene-perfluoro(alkyl vinyl ether) copolymer (PFA), polytetrafluoroethylene (PTFE), a tetrafluoroethylene-hexafluoropropylene copolymer (FEP), and the like.

Of the resin materials listed above, PFA is particularly suitably used from the viewpoints of moldability and a toner release property.

The thickness of the surface layer is preferably set to 10 μm or more and 50 μm or less. When the thickness of the surface layer is set within the range, a moderate surface hardness of the fixing member is easily maintained.

(6) Method of producing Fixing Member

The fixing member according to this aspect may be produced by, for example, a production method including the following step:

(i) a step of forming the elastic layer on the substrate through the use of a composition containing at least the fillers and raw materials for the binder (elastic layer-forming step).

In addition, the production method may include the following steps:

(ii) a step of preparing the substrate;

(iii) a step of forming the adhesion layer on the elastic layer; and (iv) a step of forming the surface layer on the elastic layer.

The step (i) may include the following steps:

(i-1) a step of preparing a composition for an elastic layer containing the fillers and the raw materials for the binder (step of preparing a composition for an elastic layer);

(i-2) a step of forming a layer containing the composition on the substrate (step of forming a composition layer);

(i-3) a step of bringing the heat conductive fillers in the composition layer into a predetermined arranged state (step of arranging the heat conductive fillers); and (i-4) a step of curing the composition layer in which the heat conductive fillers have been brought into the predetermined arranged state to form the elastic layer (curing step).

The steps (i-2) to (i-4) may be performed sequentially, or may be performed in tandem. The respective steps are described in detail below.

(ii) Step of Preparing Substrate

First, the substrate including the above-mentioned material is prepared. As described above, the shape of the substrate may be appropriately set, and may be set to, for example, an endless belt shape. A layer for imparting various functions, such as a heat insulating property, to the fixing belt may be appropriately formed on the inner surface of the substrate, and the outer surface of the substrate may be subjected to a surface treatment for imparting various functions, such as an adhesive property, to the fixing member.

(i) Elastic Layer-Forming Step (i-1) Step of Preparing Composition for Elastic Layer First, the composition for an elastic layer containing the fillers and the raw materials for the binder (e.g., a base polymer, a crosslinking agent, and a catalyst) is prepared.

(i-2) Step of forming Composition Layer

The composition is applied onto the substrate by a method such as a die molding method, a blade coating method, a nozzle coating method, or a ring coating method to form the layer of the composition.

(i-3) Step of arranging Heat Conductive Fillers

A method involving using a corona charger is described as one embodiment in which the heat conductive fillers in the composition layer formed in the step (i-2) are arrayed in its thickness direction. Corona charging systems are classified into a scorotron system in which a grid electrode is present between a corona wire and a body to be charged, and a corotron system in which no grid electrode is present; the scorotron system is preferred from the viewpoint of the controllability of the surface potential of the body to be charged.

Figure 3B:
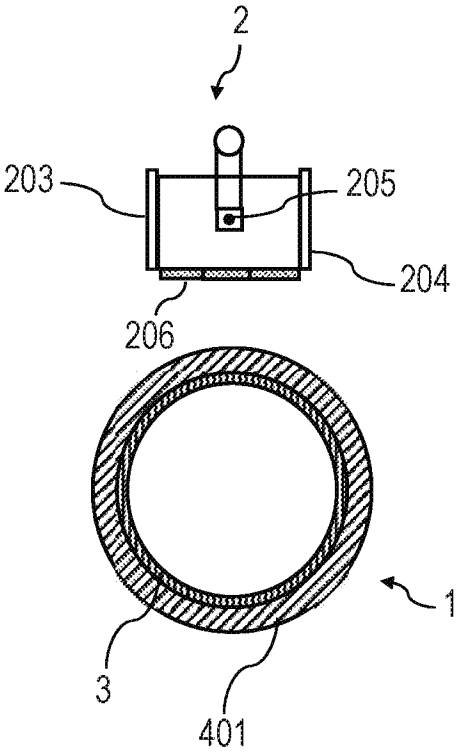
FIG. 3B is a sectional view of the corona charger.
Figure 3A:
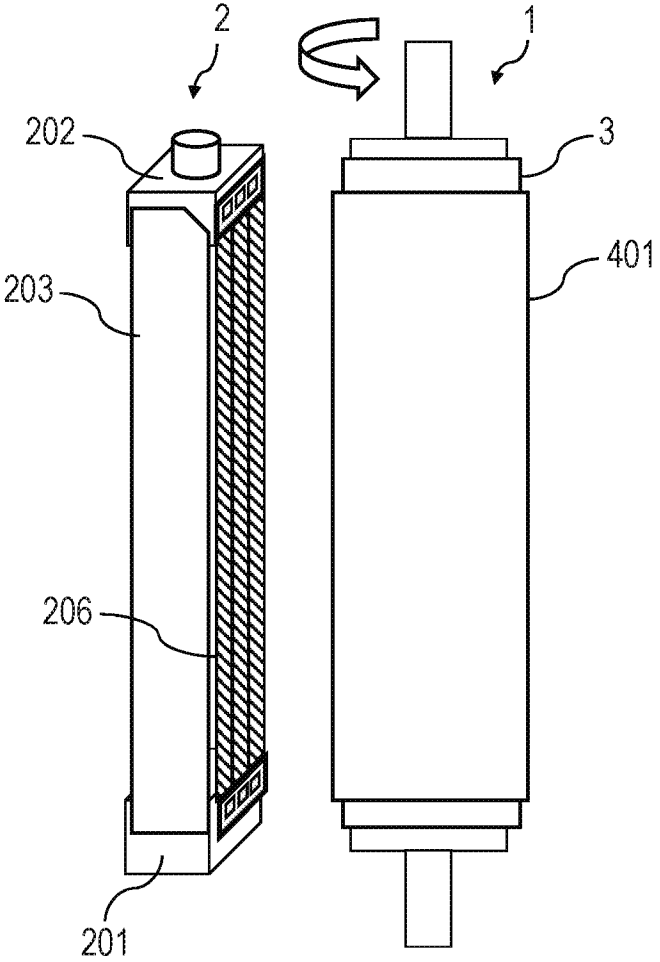
FIG. 3A is a bird's-eye view of a corona charger.

As illustrated in FIG. 3A and FIG. 3B, a corona charger 2 includes blocks 201 and 202, shields 203 and 204, and grids 206. In addition, a discharge wire 205 is tensioned between the block 201 and the block 202. A high voltage is applied to the discharge wire 205 by a high-voltage power supply (not shown), and an ion current obtained by discharge to the shields 203 and 204 is controlled by applying a high voltage to the grids 206. Thus, the surface of the composition layer is charged. At this time, the substrate 3 or a core 1 configured to hold the substrate 3 is grounded (not shown), and hence a desired electric field can be generated in the composition layer by controlling the surface potential of the surface of the composition layer.

As illustrated in FIG. 3A, the corona charger 2 is arranged near a composition layer 401 to face the layer along the width direction of the layer. Then, under a state in which a voltage is applied to the grids 206 of the corona charger 2 to cause the grids to discharge, the core 1 is rotated to rotate the substrate 3 having the composition layer 401 on its outer peripheral surface at, for example, 100 rpm for 20 seconds. Thus, the outer surface of the composition layer 401 is charged. A distance between the outer surface of the composition layer 401 and the grids 206 may be set to from 1 mm to 10 mm. The surface of the composition layer is charged as described above to generate an electric field in the composition layer. As a result, the small-particle diameter fillers each having a circle-equivalent diameter of less than 5 μm can be arrayed in the thickness direction of the composition layer. Meanwhile, the positions of the large-particle diameter fillers each having a circle-equivalent diameter of 5 μm or more in the composition layer remain substantially unchanged, and polarization occurs in the large-particle diameter fillers to generate a local electric field between the large-particle diameter fillers. The small-particle diameter fillers positioned between the large-particle diameter fillers can be arrayed by such electric field.

The absolute value of the voltage to be applied to the grids 206 preferably falls within the range of from 0.3 kV to 3 kV from the viewpoint that an effective electrostatic interaction is caused to occur between the heat conductive fillers, and the absolute value particularly preferably falls within the range of from 0.6 kV to 2 kV. When the sign of the voltage to be applied is set to be equal to the sign of the voltage to be applied to the wire, the same effect is obtained irrespective of whether the sign is negative or positive, though the direction of an electric field in the case of a negative sign is opposite to that in the case of a positive sign.

The ease with which the small-particle diameter fillers in the composition are arrayed may depend on, for example, the dielectric constants of the binder raw materials in the composition and the heat conductive fillers. For example, when the dielectric constants of the binder raw materials in the composition largely differ from the dielectric constants of the heat conductive fillers, the small-particle diameter fillers may be arrayed by a relatively small applied voltage. Therefore, it is preferred that the voltage to be applied to the grids be appropriately adjusted in accordance with the combination of materials to be used as the binder raw materials in the composition and the kinds of the heat conductive fillers.

The range of potential control in the longitudinal direction of the surface of the composition layer is preferably a range above the paper passing region of the fixing member. For example, a construction illustrated in FIG. 3A may be used, and when the voltage is applied to the grids 206 while the fixing belt is rotated by using the central axis of the substrate having the composition layer 401 as a rotation axis during the application, the entirety of the composition layer may be charged. The number of revolutions of the fixing belt is preferably set to from 10 rpm to 500 rpm, and a treatment time of 5 seconds or more is preferably provided as a treatment time for the charging from the viewpoint that the array of the small-particle diameter fillers is stably formed. As can be seen from the foregoing, the formation of the array of the small-particle diameter fillers can be controlled by controlling the surface potential of the layer and the time period for which an electric field is applied to the layer.

A material such as stainless steel, nickel, molybdenum, or tungsten may be appropriately used as the discharge wire 205; tungsten having extremely high stability among metals is preferably used. The shape of the discharge wire 205 to be tensioned inside the shields 203 and 204 is not particularly limited, and for example, a discharge wire having a shape like a saw tooth or such a discharge wire that a sectional shape when the wire is vertically cut is a circular shape (circular sectional shape) may be used. The diameter of the discharge wire 205 (in a cut surface when the wire is vertically cut) is preferably set to 40 μm or more and 100 μm or less. When the diameter of the discharge wire 205 is 40 μm or more, the breakage and tear of the discharge wire due to the collision of an ion caused by the discharge can be easily prevented. In addition, when the diameter of the discharge wire 205 is 100 μm or less, a moderate applied voltage can be applied to the discharge wire 205 at the time of the obtainment of stable corona discharge, and hence the occurrence of ozone can be easily prevented.

As illustrated in FIG. 3B, the flat plate-shaped grids 206 may be arranged between the discharge wire 205 and the composition layer 401 arranged on the substrate 3. Herein, from the viewpoint that the charged potential of the surface of the composition layer 401 is uniformized, the distance between the surface of the composition layer 401 and the grids 206 is preferably set within the range of from 1 mm or more to 10 mm or less.

(i-4) Curing Step

The composition layer is cured by heating or the like to form the elastic layer in which the positions of the heat conductive fillers in the composition layer are fixed.

Figure 6:
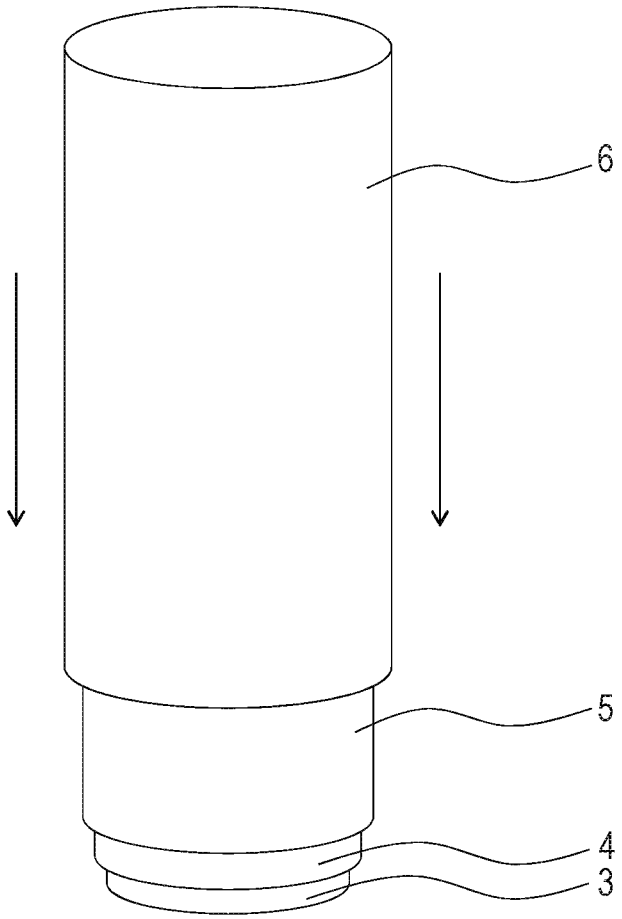
FIG. 6 is a schematic view of an example of a step of laminating a surface layer.

(iii) Step of Forming Adhesion Layer on Elastic Layer and (iv) Step of Forming Surface Layer on Elastic Layer FIG. 6 is a schematic view for illustrating an example of a step of laminating the surface layer 6 on the elastic layer 4 containing the silicone rubber via the adhesion layer 5 formed by using the addition-curable silicone rubber adhesive. First, the addition-curable silicone rubber adhesive is applied to the surface of the elastic layer 4 formed on the outer peripheral surface of the substrate 3. Further, the outer surface of the adhesive is covered with a fluorine resin tube for forming the surface layer 6 so that the tube may be laminated thereon. When the inner surface of the fluorine resin tube is subjected to a sodium treatment, an excimer laser treatment, an ammonia treatment, or the like in advance, its adhesive property may be improved.

Although a method for the covering with the fluorine resin tube is not particularly limited, for example, a method involving covering the outer surface through the use of the addition-curable silicone rubber adhesive as a lubricant, or a method involving expanding the fluorine resin tube from its outside to cover the outer surface may be employed. In addition, the redundant addition-curable silicone rubber adhesive remaining between the elastic layer 4 and the surface layer 6 formed of the fluorine resin may be removed by being squeezed out with a unit (not shown). The thickness of the adhesion layer 5 after the squeezing is preferably set to 20 μm or less from the viewpoint of a heat transfer property.

Next, the addition-curable silicone rubber adhesive is heated with a heating unit, such as an electric furnace, for a predetermined time period to be cured and to bond the elastic layer and the surface layer. Thus, the adhesion layer 5 and the surface layer 6 may be formed on the elastic layer 4. Conditions such as a heating time and a heating temperature may be appropriately set in accordance with, for example, the used adhesive. Both end portions of the resultant member in its width direction are each cut into a desired length. Thus, the fixing member can be obtained.

<Confirmation of Arrayed State of Heat Conductive Fillers in Elastic Layer>

The arrayed state of the heat conductive fillers may be confirmed by performing two-dimensional Fourier transformation through the use of a binarized image obtained from a sectional image of the elastic layer.

Figure 4A:
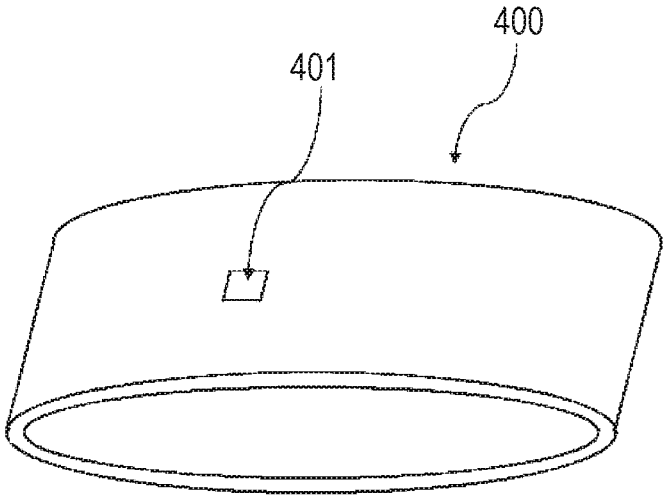
FIG. 4A and FIG. 4B are views for illustrating the first section and second section of the elastic layer of a belt-shaped fixing member.
Figure 4B:
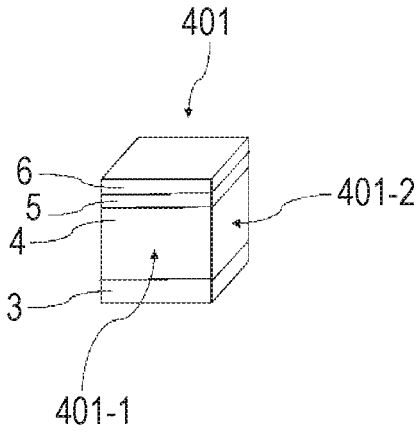

First, a measurement sample is produced. For example, when the fixing member is such a fixing belt 400 as illustrated in FIG. 4A, as illustrated in FIG. 4B, for example, 10 samples 401 each measuring 5 mm long by 5 mm wide and each having a thickness corresponding to the entire thickness of the fixing belt are collected from 10 arbitrary sites of the fixing belt. A section of each of 5 samples out of the 10 resultant samples in the peripheral direction of the fixing belt, that is, a section including a first section 401-1 in the thickness-peripheral directions of the elastic layer is subjected to polishing processing with an ion beam. In addition, a section of each of the remaining 5 samples in the direction perpendicular to the peripheral direction of the fixing belt, that is, a section including a second section 401-2 in the thickness-axial directions of the elastic layer is subjected to polishing processing with an ion beam. For example, a cross section polisher may be used in the polishing processing of a section with an ion beam. In the polishing processing of a section with an ion beam, the falling of the fillers from the sample and the inclusion of a polishing agent can be prevented, and a section having a small number of polishing marks can be formed.

Figure 5A:
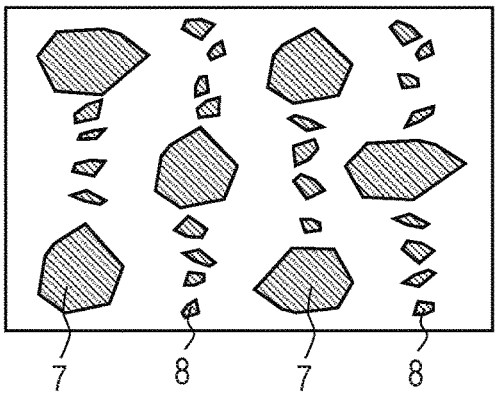
FIG. 5A, FIG. 5B, FIG. 5C, FIG. 5D, FIG. 5E, and FIG. 5F are schematic views for illustrating methods of determining the array degrees and array angles of fillers in an elastic layer.

Subsequently, for the 5 samples in each of which the first section of the elastic layer has been subjected to the polishing processing and the 5 samples in each of which the second section of the elastic layer has been subjected to the polishing processing, the first section of the elastic layer and the second section of the elastic layer are each observed with, for example, a laser microscope or a scanning electron microscope (SEM), and a sectional image of a region measuring 150 μm by 100 μm is obtained (FIG. 5A).

Figure 5B:
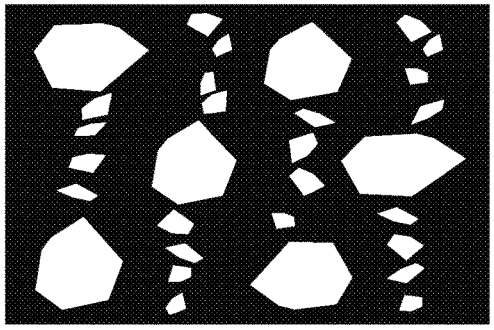

Next, the resultant image is subjected to monochromatic binarization processing with commercial image software so that a filler portion is represented as white, and a silicone rubber portion is represented as black (FIG. 5B). For example, Otsu's method may be used as an approach for the binarization.

Figure 5C:
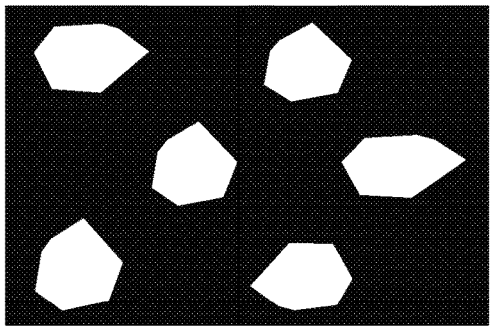
Figure 5D:
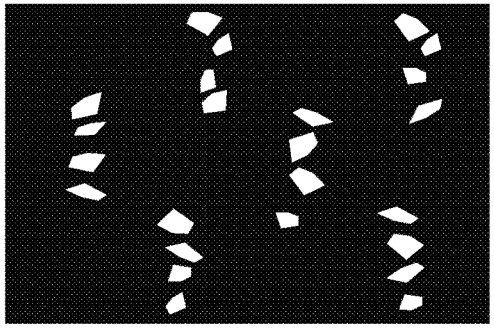

Next, the circle-equivalent diameters of the respective fillers 7 and 8 of the resultant binarized image are calculated, and the image is divided into an image in which only the large-particle diameter fillers 7 each having a circle-equivalent diameter of 5 μm or more are left (FIG. 5C) and an image in which only the small-particle diameter fillers 8 each having a circle-equivalent diameter of less than 5 μm are left (FIG. 5D). Then, the area ratio of the large-particle diameter fillers 7 or the small-particle diameter fillers 8 (the ratio of the total area of the fillers 7 or 8 to the entire area of each of the images) is calculated from each of the images. The circle-equivalent diameter of each of the fillers refers to the diameter of a circle having the same area as the area of the filler.

Figure 5E:
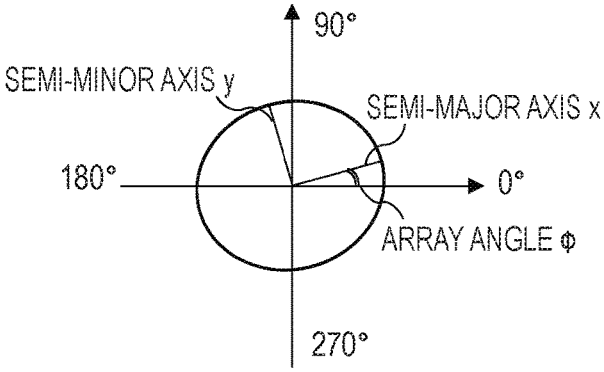
Figure 5F:
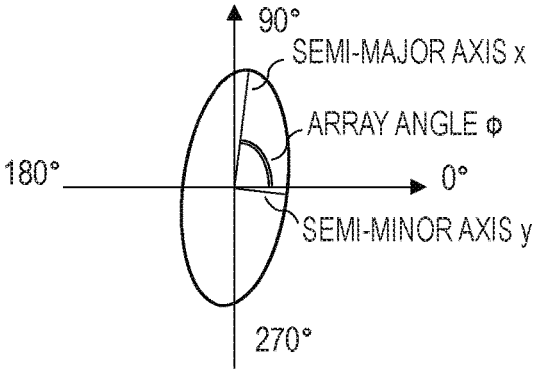

Further, when the large-particle diameter filler image and the small-particle diameter filler image are subjected to two-dimensional Fourier transformation analysis, elliptical plots each representing the direction and degree of filler array are obtained (FIG. 5E and FIG. 5F, respectively). The two-dimensional Fourier transformation itself has a peak in the direction perpendicular to the periodicity of each of the binarized images, and hence in each of the elliptical plots, a result obtained by shifting the phase of the result of the two-dimensional Fourier transformation by 90° is shown.

An array angle Φ is determined from an angle formed by the semi-major axis of the ellipse of each of the elliptical plots, and a filler array degree "f" defined as f=1−(y/x) when the semi-major axis and semi-minor axis of the ellipse are represented by x and y, respectively is determined.

The array angle Φ represents the array direction of a filler, and in each of FIG. 5E and FIG. 5F, a 90°-270° direction represents the thickness direction of the elastic layer, and a 0°-180° direction represents the peripheral direction or axial direction of the elastic layer. Therefore, a state in which the array angle Φ approaches 90° means that the filler is arrayed in the thickness direction to a higher degree.

In addition, the array degree "f" represents the ellipticity of the ellipse, and represents a value of 0 or more and less than 1. When the "f" represents 0, the ellipse becomes a circle, and hence the "f" represents a state in which the filler is not arrayed but is present in a completely random manner. As the "f" approaches 1, the ellipticity of the ellipse increases, and hence the array degree of the filler also increases.

The area ratios, array angles Φ, and array degrees "f" of fillers are measured at 5 sites in each of the first section in the thickness-peripheral directions of the elastic layer and the second section in the thickness-axial directions thereof, that is, a total of 10 sites, and the averages of the measured values are calculated. The area ratio of the fillers has the same meaning as that of the volume blending ratio of the fillers. Accordingly, when the particle size distributions of a large-particle diameter filler raw material and a small-particle diameter filler raw material are known, the volume blending ratios (area ratios) of the large-particle diameter fillers and the small-particle diameter fillers can be adjusted by their blending. However, when a strict particle size distribution is unknown, the area ratios are finally determined by image processing.

In this embodiment, the average area ratio of the large-particle diameter fillers each having a filler particle diameter (circle-equivalent diameter) of 5 μm or more is 20% or more and 40% or less. When the average area ratio of the large-particle diameter fillers is less than 20%, an interparticle distance between the large-particle diameter fillers lengthens, and hence a local electric field cannot be sufficiently generated. Accordingly, the small-particle diameter fillers present between the large-particle diameter fillers cannot be sufficiently arrayed, and hence it becomes difficult to achieve high thermal conductivity. In addition, when the average area ratio of the large-particle diameter fillers is more than 40%, it becomes difficult to sufficiently reduce the hardness of the elastic layer.

When the average array degree of the large-particle diameter fillers is represented by $f_L$, the $f_L$ is 0.00 or more and 0.15 or less. When the $f_L$ is 0.15 or less, a reduction in hardness of the elastic layer can be achieved.

When the average array angle of the large-particle diameter fillers is represented by $\Phi_L$, the $\Phi_L$ may represent any value of 0° or more and 180° or less.

The average area ratio of the small-particle diameter fillers each having a filler particle diameter of less than 5 μm is 10% or more and 20% or less. When the average area ratio of the small-particle diameter fillers is 10% or more, sufficiently high thermal conductivity can be achieved. In addition, when the average area ratio of the small-particle diameter fillers is 20% or less, a problem in terms of the processability or smoothness of the elastic layer resulting from an increase in viscosity of a material for the layer can be prevented from occurring.

When the average array degree of the small-particle diameter fillers is represented by $f_S$, the $f_S$ is 0.20 or more and 0.50 or less. When the $f_S$ falls within the range, the thermal conductivity of the elastic layer in its thickness direction can be improved. When the average array angle of the small-particle diameter fillers is represented by $\Phi_S$, the $\Phi_S$ is 60° or more and 120° or less. The direction in which the $\Phi_S$ becomes 90° is the thickness direction of the elastic layer. Accordingly, as the $\Phi_S$ approaches 90°, the small-particle diameter fillers are arrayed in the thickness direction to a higher degree. Accordingly, when the $\Phi_S$ falls within the range, the thermal conductivity in the thickness direction can be improved.

The thermal conductivity λ of the elastic layer in its thickness direction may be calculated from the following equation:

$$\lambda=\alpha\times C_p\times\rho$$

where λ represents the thermal conductivity of the elastic layer in the thickness direction (W/(m·K)), α represents a thermal diffusivity in the thickness direction ($m^2/s$), $C_p$ represents a specific heat at constant pressure (J/(kg·K)), and ρ represents a density ($kg/m^3$). Methods of measuring the respective parameters are described in detail in Examples.

In addition, a hardness or a tensile modulus serves as a criterion for evaluating the softness of the elastic layer. For example, the hardness may be measured based on JIS K7312, or may be measured with a microrubber hardness meter (MD-1 TYPE-C HARDNESS METER, manufactured by Asker). The tensile modulus is measured as described below. A sample piece is cut out of the elastic layer with a punching die (dumbbell shape No. 8 specified in JIS K6251: 2004), and the thicknesses of measurement sites are measured. Next, the tensile modulus of the sample piece that has been cut out may be measured with, for example, a tensile tester (apparatus name: STROGRAPH EII-L1, manufactured by Toyo Seiki Seisaku-sho, Ltd.) at room temperature and a tensile rate of 200 mm/min. The tensile modulus is a gradient when a graph in which the strain of the sample piece is indicated by an axis of abscissa and a tensile stress is indicated by an axis of ordinate is produced from the measurement results, and measurement data is linearly approximated in the strain range of from 0% to 10%.

When the thermal conductivity of the elastic layer in the thickness direction is set to 1.30 W/(m·K) or more, satisfactory fixation can be performed. Further, when the thermal conductivity is 1.50 W/(m·K) or more, more satisfactory fixation can be performed.

(7) Heat Fixing Device

A heat fixing device according to this embodiment includes a pair of heated rotating bodies like a roller and a roller, a belt and a roller, or a belt and a belt brought into pressure contact with each other. The kind of the heat fixing device is appropriately selected in consideration of conditions such as a process speed and a size as the entire electrophotographic image forming apparatus to which the heat fixing device is mounted.

In the heat fixing device, a fixing member and a pressurizing member each of which has been heated are brought into press contact with each other to form a fixing nip N, and a recording medium S serving as a body to be heated, the recording medium having formed thereon images with unfixed toners, is interposed and conveyed into the fixing nip N. The images formed with the unfixed toners are referred to as 'toner images "t".' Thus, the toner images "t" are heated and pressurized. As a result, the toner images "t" are melted and subjected to coloring mixing. After that, the toner images are cooled. Thus, an image is fixed onto the recording medium.

The construction of the heat fixing device is described below by way of specific examples of the device, but the scope and applications of the present disclosure are not limited thereto.

(7-1) Heat Fixing Device of Heating Belt-Pressurizing Belt System

Figure 7:
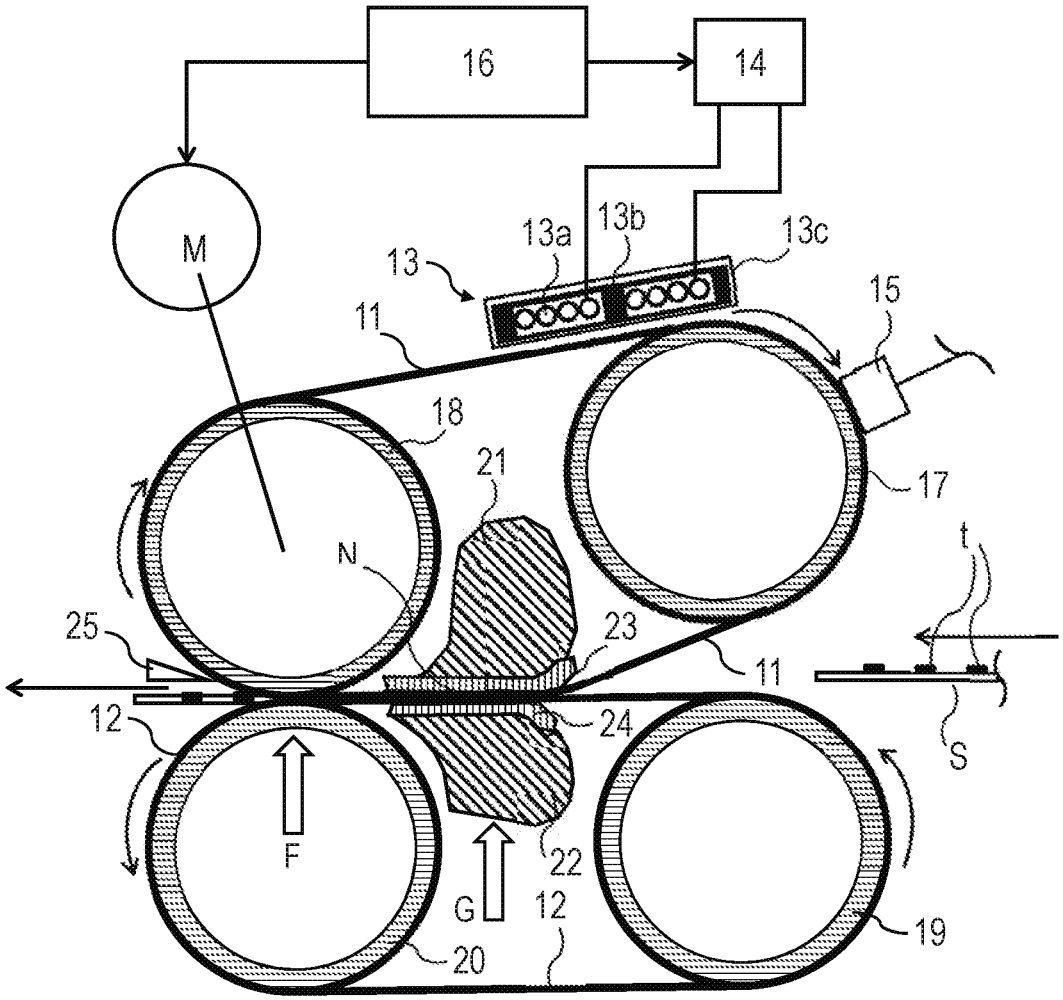
FIG. 7 is a schematic sectional view of an example of a heat fixing device of a heating belt-pressurizing belt system.

FIG. 7 is a schematic sectional view of an example of a heat fixing device of a so-called twin-belt system in which a pair of rotating bodies like a heating belt 11 and a pressurizing belt 12 is brought into press contact, the heat fixing device including the heating belt as a heating member. Herein, the width direction of the heat fixing device or a member forming the device is the direction vertical to the paper surface of FIG. 7. The front surface of the heat fixing device is a surface on a side where the recording medium S is introduced. The term "left" or "right" refers to the left or the right when the device is viewed from the front surface. The width of the belt is a belt dimension in a horizontal direction when the device is viewed from the front surface. The width of the recording medium S is the dimension of the recording medium in the direction perpendicular to its conveying direction. Further, the term "upstream" or "downstream" refers to upstream or downstream with respect to the direction in which the recording medium is conveyed.

The heat fixing device includes the heating belt 11 serving as a fixing member and the pressurizing belt 12. The heating belt 11 and the pressurizing belt 12 are each obtained by tensioning such a heating belt as illustrated in FIG. 2A, the belt including a metal flexible substrate using nickel as a main component, between two rollers.

A heat source that can be heated by electromagnetic induction heating (an induction heating member or an exciting coil) having high energy efficiency is adopted as a unit for heating the heating belt 11. An induction heating member 13 includes an induction coil 13*a*, an exciting core 13*b*, and a coil holder 13*c* configured to hold the coil and the core. The induction coil 13*a* uses a Litz wire flatly wound in an elliptical shape and is arranged in the horizontal E-shaped exciting core 13*b* protruding toward the center and both sides of the induction coil. A material having a high magnetic permeability and a low residual magnetic flux density, such as a ferrite or a permalloy, is used as a material for the exciting core 13*b*, and hence a loss in the induction coil 13*a* or the exciting core 13*b* can be suppressed and the heating belt 11 can be efficiently heated.

When a high-frequency current is flowed from an exciting circuit 14 to the induction coil 13*a* of the induction heating member 13, the substrate of the heating belt 11 causes induction heat generation and hence the heating belt 11 is heated from a substrate side. The temperature of the surface of the heating belt 11 is detected by a temperature detector element 15, such as a thermistor. A signal concerning the temperature of the heating belt 11 detected by the temperature detector element 15 is sent to a control circuit portion 16. The control circuit portion 16 controls electric power supplied from the exciting circuit 14 to the induction coil 13*a* so that temperature information received from the temperature detector element 15 may be maintained at a predetermined fixation temperature, to thereby adjust the temperature of the heating belt 11 to the predetermined fixation temperature.

The heating belt 11 is tensioned by a roller 17 and a heating side roller 18 serving as belt rotating members. The roller 17 and the heating side roller 18 are rotatably supported with bearings between the left and right side plates (not shown) of the device.

The roller 17 is, for example, a hollow roller made of iron having an outer diameter of 20 mm, an inner diameter of 18 mm, and a thickness of 1 mm, and functions as a tension roller for providing the heating belt 11 with tension. The heating side roller 18 is, for example, a highly slidable elastic roller obtained by providing a mandrel made of an iron alloy having an outer diameter of 20 mm and a diameter of 18 mm with a silicone rubber layer serving as an elastic layer.

A driving force is input from a driving source (motor) M into the heating side roller 18 as a drive roller through a drive gear train (not shown), and hence the roller is rotationally driven in a clockwise direction indicated by the arrow at a predetermined speed. When the heating side roller 18 is provided with the elastic layer as described above, the driving force input into the heating side roller 18 can be satisfactorily transferred to the heating belt 11, and a fixing nip for securing the separability of the recording medium from the heating belt 11 can be formed. When the heating side roller 18 includes the elastic layer, a shortening effect on a warm-up time is exhibited because the layer reduces the conduction of heat into the heating side roller.

When the heating side roller 18 is rotationally driven, the heating belt 11 rotates together with the roller 17 by virtue of friction between the silicone rubber surface of the heating side roller 18 and the inner surface of the heating belt 11. The arrangement and sizes of the roller 17 and the heating side roller 18 are selected in accordance with the size of the heating belt 11. For example, the dimensions of the roller 17 and the heating side roller 18 are selected so that the heating belt 11 having an inner diameter of 55 mm when not mounted on the rollers may be tensioned therebetween.

The pressurizing belt 12 is tensioned by a tension roller 19 and a pressurization side roller 20 serving as belt rotating members. The inner diameter of the pressurizing belt when not mounted on the rollers is, for example, 55 mm. The tension roller 19 and the pressurization side roller 20 are rotatably supported with bearings between the left and right side plates (not shown) of the device.

For example, the tension roller 19 is obtained by providing a mandrel made of an iron alloy having an outer diameter of 20 mm and a diameter of 16 mm with a silicone sponge layer for reducing a thermal conductivity to reduce the conduction of heat from the pressurizing belt 12. The pressurization side roller 20 is, for example, a lowly slidable rigid roller made of an iron alloy having an outer diameter of 20 mm, an inner diameter of 16 mm, and a thickness of 2 mm. The dimensions of the tension roller 19 and the pressurization side roller 20 are similarly selected in accordance with the dimensions of the pressurizing belt 12.

Herein, in order that a fixing nip portion N may be formed between the heating belt 11 and the pressurizing belt 12, both the left and right end sides of the rotation axis of the pressurization side roller 20 are pressurized toward the heating side roller 18 with a predetermined pressurizing force in a direction indicated by the arrow F by a pressurizing mechanism (not shown).

In addition, the following pressurizing pads are adopted for obtaining the wide fixing nip portion N without increasing the size of the device: a fixing pad 21 serving as a first pressurizing pad for pressurizing the heating belt 11 toward the pressurizing belt 12; and a pressurizing pad 22 serving as a second pressurizing pad for pressurizing the pressurizing belt 12 toward the heating belt 11. The fixing pad 21 and the pressurizing pad 22 are supported and arranged between the left and right side plates (not shown) of the device. The pressurizing pad 22 is pressurized toward the fixing pad 21 with a predetermined pressurizing force in a direction indicated by the arrow G by a pressurizing mechanism (not shown). The fixing pad 21 serving as the first pressurizing pad includes a pad substrate and a sliding sheet (low friction sheet) 23 in contact with the belt. The pressurizing pad 22 serving as the second pressurizing pad also includes a pad substrate and a sliding sheet 24 in contact with the belt. This is because there is a problem in that the shaving of a portion of the pad that rubs against the inner peripheral surface of the belt increases. When each of the sliding sheets 23 and 24 is interposed between the belt and the pad substrate, the shaving of the pad can be prevented and the sliding resistance of the belt can be reduced, and hence a good belt traveling property and good belt durability can be secured.

The heating belt is provided with a non-contact antistatic brush (not shown) and the pressurizing belt is provided with a contact antistatic brush (not shown).

The control circuit portion 16 drives a motor M at least at the time of the performance of image formation. Thus, the heating side roller 18 is rotationally driven and the heating belt 11 is rotationally driven in the same direction. The pressurizing belt 12 rotates following the heating belt 11. Herein, the most downstream portion of the fixing nip has such a construction that the recording medium is conveyed while the heating belt 11 and the pressurizing belt 12 are sandwiched between a pair of the rollers 18 and 20, and hence the belts can be prevented from slipping. The most downstream portion of the fixing nip is a portion in which a pressure distribution in the fixing nip (in the direction in which the recording medium is conveyed) becomes maximum.

Under a state in which the temperature of the heating belt 11 is increased to the predetermined fixation temperature and maintained (that is, the temperature is controlled), the recording medium S having the unfixed toner images "t" is conveyed into the fixing nip portion N between the heating belt 11 and the pressurizing belt 12. The recording medium S is introduced with its surface bearing the unfixed toner images "t" directed toward the heating belt 11. Then, the unfixed toner images "t" of the recording medium S are interposed and conveyed while closely adhering to the outer peripheral surface of the heating belt 11. Thus, heat is applied from the heating belt 11 to the images and the images receive a pressurizing force to be fixed onto the surface of the recording medium S. At this time, heat from the heated substrate of the heating belt 11 is efficiently transported toward the recording medium S through the elastic layer improved in thermal conductivity in its thickness direction. After that, the recording medium S is separated from the heating belt by a separating member 25 and conveyed.

(7-2) Heat Fixing Device of Heating Belt-Pressurizing Roller System

Figure 8:
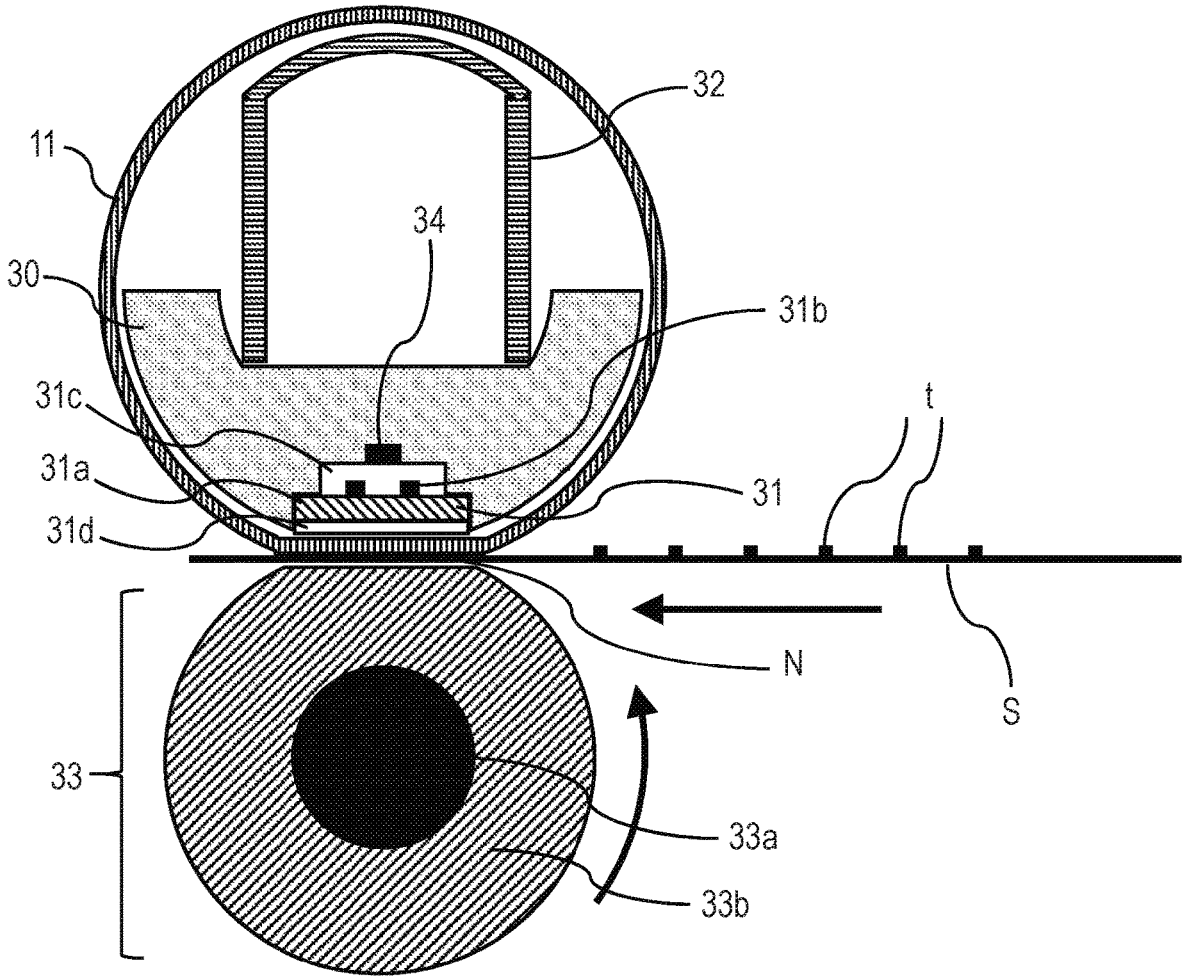
FIG. 8 is a schematic sectional view of an example of a heat fixing device of a heating belt-pressurizing roller system.

FIG. 8 is a schematic view for illustrating an example of a heat fixing device of a heating belt-pressurizing roller system using a ceramic heater as a heating body. In FIG. 8, the fixing member according to this embodiment may be used as the cylindrical or endless belt-shaped heating belt 11. A heat-resistant and heat-insulating belt guide 30 for holding the heating belt 11 is present, and at a position in contact with the heating belt 11 (substantially the central portion of the lower surface of the belt guide 30), a ceramic heater 31 configured to heat the heating belt 11 is fixed and supported by being fitted into a groove portion formed and provided along the longitudinal direction of the guide. In addition, the heating belt 11 is loosely fitted onto the belt guide 30. In addition, a rigid stay 32 for pressurization is inserted into the belt guide 30.

Meanwhile, a pressurizing roller 33 is arranged so as to face the heating belt 11. In this example, the pressurizing roller 33 is an elastic pressurizing roller, that is, an elastic layer 33*b* of a silicone rubber is arranged on a mandrel 33*a* to reduce its hardness, and the roller is arranged by rotatably holding both end portions of the mandrel 33*a* with bearings between chassis side plates on the front side and rear side (not shown) of the device. The elastic pressurizing roller is covered with a tetrafluoroethylene-perfluoroalkyl ether copolymer (PFA) tube for improving its surface property.

A pressurizing spring (not shown) is contractedly arranged between each of both end portions of the rigid stay 32 for pressurization and a spring-receiving member (not shown) on a device chassis side to apply a depression force to the rigid stay 32 for pressurization. Thus, the lower surface of the ceramic heater 31 arranged on the lower surface of the belt guide 30 made of a heat-resistant resin and the upper surface of the pressurizing roller 33 are brought into press contact with each other with the heating belt 11 sandwiched therebetween to form the fixing nip portion N.

The pressurizing roller 33 is rotationally driven in a counterclockwise direction as indicated by the arrow by a driving unit (not shown). A frictional force between the pressurizing roller 33 and the outer surface of the heating belt 11 caused by the rotational driving of the pressurizing roller 33 applies a rotational force to the heating belt 11, and hence the heating belt 11 rotates outside the belt guide 30 in a clockwise direction as indicated by the arrow at a peripheral speed substantially corresponding to the rotational peripheral speed of the pressurizing roller 33 while its inner surface slides under a state of being in close contact with the lower surface of the ceramic heater 31 in the fixing nip portion N (pressurizing roller driving system).

The rotation of the pressurizing roller 33 is started and the heat-up of the ceramic heater 31 is started based on a print start signal. At the instant when the peripheral speed of the rotation of the heating belt 11 by the rotation of the pressurizing roller 33 is made steady, and the temperature of a temperature detector element 34 arranged on the upper surface of the ceramic heater rises up to a predetermined temperature, for example, 180° C., the recording medium S bearing the unfixed toner images "t", which serves as a material to be heated, is introduced between the heating belt 11 and the pressurizing roller 33 in the fixing nip portion N with its toner image-bearing surface side directed toward the heating belt 11. Then, the recording medium S is in close contact with the lower surface of the ceramic heater 31 in the fixing nip portion N via the heating belt 11, and moves and passes through the fixing nip portion N together with the heating belt 11. In the moving and passing process, the heat of the heating belt 11 is applied to the recording medium S to heat the toner images "t" and to fix the images onto the surface of the recording medium S. The recording medium S that has passed through the fixing nip portion N is separated from the outer surface of the heating belt 11 and conveyed.

The ceramic heater 31 serving as a heating body is a low-heat capacity and oblong linear heating body whose longitudinal direction is the direction perpendicular to the moving direction of the heating belt 11 and the recording medium S. The basic construction of the ceramic heater 31 is preferably as follows: the heater includes a heater substrate 31*a*, heat-generating layers 31*b* arranged on the surface of the heater substrate 31*a* along its longitudinal direction, a protective layer 31*c* arranged on the layers, and a sliding member 31*d*. Herein, the heater substrate 31*a* may include, for example, aluminum nitride. The heat-generating layers 31*b* may each be formed by applying an electrical resistance material, such as a silver-palladium (Ag—Pd) alloy, through screen printing or the like so that the material may have a thickness of about 10 μm and a width of from 1 mm to 5 mm. The protective layer 31*c* may include glass, a fluorine resin, or the like. The ceramic heater to be used in the heat fixing device is not limited to such heater.

Then, when an electric current is flowed between both ends of each of the heat-generating layers 31*b* of the ceramic heater 31, the heat-generating layer 31*b* generates heat, and hence the temperature of the heater 31 rapidly increases. The ceramic heater 31 is fixed and supported by being fitted into the groove portion formed and provided in substantially the central portion of the lower surface of the belt guide 30 along the longitudinal direction of the guide with its protective layer 31*c* side directed upward. In the fixing nip portion N in contact with the heating belt 11, the surface of the sliding member 31*d* of the ceramic heater 31 and the inner surface of the heating belt 11 slide while being in contact with each other.

As described above, the heating belt 11 improves the thermal conductivity of the elastic layer containing the silicone rubber in its thickness direction, and suppresses the hardness of the layer to a low level. With such construction, the heating belt 11 can efficiently heat the unfixed toner images, and can fix a high-quality image to the recording medium S at the time of its passing through the fixing nip because of the low hardness.

As described above, according to one aspect of the present disclosure, there is provided a heat fixing device having arranged therein a fixing member. Therefore, a heat fixing device having arranged therein a fixing member excellent in fixing performance and image quality can be provided.

According to one aspect of the present disclosure, the fixing member having high thermal conductivity in its thickness direction and having a low hardness can be provided. According to another aspect of the present disclosure, the heat fixing device that can form a high-quality electrophotographic image can also be provided.

EXAMPLES

The present disclosure is described in more detail below by way of Examples.

[Hardness Unevenness Comparison Test]

Hardness unevenness comparison was performed by using an elastic layer sample produced by using parallel flat plate electrodes and an elastic layer sample produced by using a corona charger, the sample serving as Example of the present disclosure.

(1) Preparation of Liquid Addition-Curable Silicone Rubber Composition

First, 98.6 parts by mass of a silicone polymer having vinyl groups serving as unsaturated aliphatic groups only at both terminals of its molecular chain and further having a methyl group serving as an unsubstituted hydrocarbon group free of any unsaturated aliphatic group (product name: DMS-V35, manufactured by Gelest, Inc., viscosity: 5,000 $mm^2/s$, hereinafter referred to as "Vi") was prepared as the component (a). The silicone polymer is such a polymer that, in the structural formula 2, $R_{3S}$ each represent a methyl group and $R_{4S}$ each represent a vinyl group.

Next, 253 parts by mass of magnesium oxide (product name: SL-WR, manufactured by Konoshima Chemical Co., Ltd., average particle diameter: 10 μm) was added as a heat conductive filler A to the Vi so that its amount became 37 vol % with respect to the silicone component. Further, 19 parts by mass of magnesium oxide (product name: PSF-WR, manufactured by Konoshima Chemical Co., Ltd., average particle diameter: 1 μm) was added as a heat conductive filler B to the mixture so that its amount became 3 vol % with respect to the silicone component, followed by sufficient mixing. Thus, a mixture 1 was obtained.

Next, a solution obtained by dissolving 0.2 part by mass of 1-ethynyl-1-cyclohexanol (manufactured by Tokyo Chemical Industry Co., Ltd.) serving as a curing retarder in the same weight of toluene was added to the mixture 1. Thus, a mixture 2 was obtained.

Next, 0.1 part by mass of a hydrosilylation catalyst (platinum catalyst: a mixture of a 1,3-divinyltetramethyldisiloxane platinum complex, 1,3-divinyltetramethyldisiloxane, and 2-propanol) was added as the component (c) to the mixture 2. Thus, a mixture 3 was obtained.

Further, 1.4 parts by mass of a silicone polymer having a linear siloxane skeleton and having an active hydrogen group bonded to silicon only in a side chain thereof (product name: HMS-301, manufactured by Gelest, Inc., viscosity: 30 $mm^2/s$) was weighed as the component (b). The polymer was added to the mixture 3, and the whole was sufficiently mixed to provide a liquid addition-curable silicone rubber composition.

(2-1) Production of Parallel Flat Plate Electrode Sample

The silicone rubber composition was sandwiched between an acrylic spacer having a thickness of 500 μm and 50-millimeter square ITO glass electrodes to produce a sample piece having a thickness of 500 μm.

A power supply was connected to the ITO glass electrodes, and the silicone rubber composition was cured under the conditions of 80° C. and 2 hours while an AC voltage having an amplitude of 950 V and a frequency of 60 Hz was applied thereto. After that, the silicone rubber cured product was peeled from the electrodes, and was subjected to secondary curing at 200° C. for 30 minutes to provide a parallel flat plate electrode sample.

(2-2) Production of Corona-charged Sample

The silicone rubber composition was applied onto a SUS film with a slit coater to form an uncured film having a thickness of 500 μm. The SUS film was bonded to a cylindrical core, and was subjected to a charging treatment with a corona charger while being rotated. Conditions for the treatment were as follows: a rotational speed was 100 rpm, an electric current supplied to the wire of the corona charger was −150 μA, the potential of a grid electrode was −950 V, a charging time was 20 seconds, and a distance between the grid electrode and the uncured film was 4 mm.

The uncured sample that had been charged was heated in an electric furnace at 160° C. for 1 minute (primary curing), and was then heated in an electric furnace at 200° C. for 30 minutes (secondary curing) so that the silicone rubber composition was cured. Thus, a corona-charged sample was obtained.

(3) Evaluation of Hardness Unevenness of Sample

Each of the resultant samples was adjusted to have a 50-millimeter square shape, and rubber hardnesses were measured at 10 sites in its surface with a microrubber hardness meter (MD-1 TYPE-C HARDNESS METER, manufactured by Asker), followed by the calculation of a rubber hardness average and a standard deviation.

The results were as follows: while the corona-charged sample had a rubber hardness average of 62.1° and a standard deviation of 1.5°, the parallel flat plate electrode sample had a rubber hardness average of 63.0° and a standard deviation of 7.0°. It was found that the parallel flat plate electrode sample had large hardness unevenness and was hence difficult to apply to a fixing member.

Example 1

(1) Preparation of Liquid Addition-curable Silicone Rubber Composition

A liquid addition-curable silicone rubber composition was obtained in the same manner as in the production of a sample to be used in the hardness unevenness comparison test.

(2) Production of Heating Belt

A nickel electrocast endless belt having an inner diameter of 55 mm, a width of 420 mm, and a thickness of 65 μm was prepared as a substrate. In a series of production steps, the endless belt was handled while a core was inserted into the belt. First, a primer (product name: DY39-051A/B, manufactured by Dow Corning Toray Co., Ltd.) was applied to the outer peripheral surface of the substrate in a substantially uniform manner so that its dry weight became 50 mg. After the solvent had been dried, a baking treatment was performed in an electric furnace set to 160° C. for 30 minutes.

A silicone rubber composition layer having a thickness of 450 μm was formed on the substrate subjected to the primer treatment by a ring coating method. Next, a corona charger was arranged to face the substrate having the silicone rubber composition layer on its outer peripheral surface along the generating line thereof, and the outer surface of the silicone rubber composition layer was charged while the substrate was rotated at 100 rpm. Conditions for the charging were as follows: an electric current supplied to the discharge wire of the corona charger was −150 μA, the potential of a grid electrode was −950 V, a charging time was 20 seconds, and a distance between the grid electrode and the outer surface of the silicone rubber composition layer was 4 mm.

Next, the substrate was loaded into an electric furnace and heated at a temperature of 160° C. for 1 minute so that the silicone rubber composition layer was subjected to primary curing. After that, the substrate was heated at a temperature of 200° C. for 30 minutes so that the silicone rubber composition layer was subjected to secondary curing. Thus, an elastic layer was formed.

Next, an addition-curable silicone rubber adhesive for forming an adhesion layer (product name: SE1819CV A/B, manufactured by Dow Corning Toray Co., Ltd.) was applied to the surface of the elastic layer in a substantially uniform manner so as to have a thickness of about 20 μm. A fluorine resin tube having an inner diameter of 52 mm and a thickness of 40 μm for forming a surface layer (product name: NSE, manufactured by Gunze Limited) was laminated thereon while its diameter was expanded. After that, the surface of the belt was uniformly squeezed from above the fluorine resin tube. Thus, the redundant adhesive was squeezed out of a space between the elastic layer and the fluorine resin tube so that the thickness of the adhesive became as small as about 5 μm. Next, the substrate was loaded into an electric furnace and heated at a temperature of 200° C. for 1 hour so that the adhesive was cured to fix the fluorine resin tube onto the elastic layer. Thus, a fixing belt was obtained.

(3) Evaluation of Elastic Layer of Fixing Belt (3-1) Evaluations of Area Ratio and Array Properties of Fillers in Section in Thickness Direction of Elastic Layer Ten measurement samples were cut out of 10 arbitrary sites of the produced fixing belt, and a section of each of 5 measurement samples out of the 10 measurement samples in the peripheral direction of the fixing belt was subjected to polishing processing with an ion beam by the method described in the foregoing. A section of each of the remaining 5 measurement samples in the direction perpendicular to the peripheral direction of the fixing belt was subjected to polishing processing with an ion beam. A cross section polisher (product name: SM-09010, manufactured by JEOL Ltd.) was used in any such polishing processing. Any such polishing processing was performed in an argon gas atmosphere by setting an applied voltage to 4.5 V and applying an ion beam from a substrate side in the thickness direction of the fixing belt over 11 hours. The polishing-processed surface of each measurement sample was observed with a laser microscope (product name: OLS3000, manufactured by Olympus Corporation, using a 50× objective lens). Thus, a sectional image of a size measuring 150 μm by 100 μm was obtained.

Each of the 10 resultant sectional images was subjected to binarization processing with image processing software "ImageJ". Otsu's method was used as a binarization method. The area ratios of large-particle diameter fillers each having a filler particle diameter of 5 μm or more were determined from the resultant binarized images, and their arithmetic average was calculated. Similarly, the area ratios of small-particle diameter fillers each having a filler particle diameter of less than 5 μm were calculated, and their arithmetic average was calculated. Next, each binarized image was subjected to two-dimensional Fourier transformation processing. The array degrees $f_L$ of the large-particle diameter fillers were determined from elliptical plots obtained as a result of the two-dimensional Fourier transformation processing, and their arithmetic average was determined. Similarly, the array degrees $f_S$ of the small-particle diameter fillers were determined, and their arithmetic average was determined. Further, the array angles $\Phi_S$ of the small-particle diameter fillers were determined, and their arithmetic average was determined.

(3-2) Thermal Conductivity of Elastic Layer in its Thickness Direction

The thermal conductivity λ of the elastic layer in its thickness direction was calculated from the following equation:

$$\lambda=\alpha\times C_p\times\rho$$

where λ represents the thermal conductivity of the elastic layer in the thickness direction (W/(m·K)), α represents a thermal diffusivity in the thickness direction ($m^2/s$), $C_p$ represents a specific heat at constant pressure (J/(kg·K)), and p represents a density ($kg/m^3$). Herein, the values of the thermal diffusivity α in the thickness direction, the specific heat at constant pressure $C_p$, and the density ρ were determined by the following methods.

Thermal Diffusivity α

The thermal diffusivity α of the elastic layer in the thickness direction was measured with a periodical heating method thermal diffusivity measurement system (product name: FTC-1, manufactured by Advance Riko, Inc.) at room temperature (25° C.). A sample piece having an area measuring 8 mm by 12 mm was cut out of the elastic layer with a cutter, and a total of 5 sample pieces were produced. The thicknesses of the respective sample pieces were measured with a digital length measuring system (product name: DIGIMICRO MF-501, flat probe ϕ4 mm, manufactured by Nikon Corporation). Next, the thermal diffusivity of each of the sample pieces was measured a total of 5 times, and the average ($m^2/s$) of the measured values was determined. The measurement was performed while the sample piece was pressurized with a weight of 1 kg.

As a result, the thermal diffusivity α of the silicone rubber elastic layer in the thickness direction was $6.01\times10^{-7}$ $m^2/s$.

Specific Heat at Constant Pressure $C_p$

The specific heat at constant pressure of the elastic layer was measured with a differential scanning calorimeter (product name: DSC823e, manufactured by Mettler-Toledo).

Specifically, pans made of aluminum were used as a pan for a sample and a reference pan. First, as blank measurement, under a state in which both the pans were empty, measurement was performed by the following program: a temperature in the calorimeter was kept constant at 15° C. for 10 minutes, was then increased to 215° C. at a rate of temperature increase of 10° C./min, and was kept constant at 215° C. for 10 minutes. Next, measurement was performed through the use of 10 mg of synthetic sapphire whose specific heat at constant pressure was known as a reference substance by the same program. Next, the same amount of a measurement sample as that of the synthetic sapphire serving as the reference substance, that is, 10 mg thereof was cut out of the elastic layer. After that, the sample was set in the sample pan, and measurement was performed by the same program. Those measurement results were analyzed with specific heat analysis software attached to the differential scanning calorimeter, and the specific heat at constant pressure $C_p$ at 25° C. was calculated from the average of the 5 measurement results.

As a result, the specific heat at constant pressure of the silicone rubber elastic layer was 1.13 J/(g·K).

Density ρ

The density of the elastic layer was measured with a dry automatic densimeter (product name: ACCUPYC 1330-01, manufactured by Shimadzu Corporation).

Specifically, a sample cell having a volume of 10 $cm^3$ was used, and a sample piece was cut out of the elastic layer so as to account for about 80% of the volume of the cell. The mass of the sample piece was measured, and then the sample piece was loaded into the sample cell. The sample cell was set in a measuring portion in the apparatus. Helium was used as a gas for measurement, and the cell was purged with the gas. After that, the volume of the sample piece was measured 10 times. The density of the elastic layer was calculated from the mass of the sample piece and the measured volume for each measurement, and the average of the calculated values was determined.

As a result, the density of the silicone rubber elastic layer was 2.06 $g/cm^3$.

The thermal conductivity λ of the elastic layer in the thickness direction was calculated from the specific heat at constant pressure $C_p$ (J/(kg·K)) and density p ($kg/m^3$) of the elastic layer each of which had been subjected to unit conversion, and the measured thermal diffusivity α ($m^2/s$). As a result, the thermal conductivity was 1.40 W/(m·K).

(3-3) Tensile Modulus of Elastic Layer

The tensile modulus of the elastic layer was measured for confirming that the hardness of the elastic layer was low. Specifically, a sample piece was cut out of the elastic layer with a punching die (dumbbell shape No. 8 specified in JIS K6251:2004), and the thickness of the vicinity of its center serving as a measurement site was measured. Next, the sample piece that had been cut out was tested with a tensile tester (apparatus name: STROGRAPH EII-L1, manufactured by Toyo Seiki Seisaku-sho, Ltd.) at a tensile rate of 200 mm/min and room temperature. The tensile modulus was a gradient when a graph in which the strain of the sample piece was indicated by an axis of abscissa and a tensile stress was indicated by an axis of ordinate was produced from the measurement results, and measurement data was linearly approximated in the strain range of from 0% to 10%. As a result, the tensile modulus of the elastic layer was 0.41 MPa.

(4) Evaluation of Fixing Belt

The fixing belt thus obtained was incorporated into the heat fixing device of an electrophotographic copying machine (product name: imagePRESS (trademark) C850, manufactured by Canon Inc.). Then, the heat fixing device was mounted on the copying machine. A cyan solid image was formed on cardboard having a basis weight of 300 $g/m^2$ (product name: UPM Finesse gloss 300 $g/m^2$, manufactured by UPM) with the copying machine while the fixation temperature of the heat fixing device was set to be lower than a standard fixation temperature. Specifically, 5 cyan solid images were continuously formed while the fixation temperature of the heat fixing device was adjusted from 195° C. serving as the standard fixation temperature to 185° C., and the image density of the fifth solid image was measured. Next, the toner surface of the solid image was rubbed with lens-cleaning paper having applied thereto a load of 4.9 kPa (50 $g/cm^2$) in the same direction 3 times, and its image density after the rubbing was measured. Then, when the percentage by which the image density after the rubbing reduced as compared to that before the rubbing (=[difference between image densities before and after rubbing]/[image density before rubbing]×100) was less than 5%, it was judged that the toner fixed to the cardboard. The result was evaluated by the following criteria. The image densities were measured with a reflection densitometer (manufactured by Macbeth). In addition, a state in which the toner fixed to the cardboard was evaluated in the same manner as that described above except that the fixation temperature was adjusted to 180° C.

Rank A: The toner fixed to the cardboard at a fixation temperature of 180° C.

Rank B: The toner fixed to the cardboard at a fixation temperature of 185° C.

Rank C: The toner did not fix to the cardboard at a fixation temperature of 185° C.

In addition, the fifth solid image was visually observed, and the presence or absence of gloss unevenness, and its degree were evaluated by the following criteria.

Rank A: The solid image was free of any gloss unevenness, and was extremely excellent in image quality.

Rank B: The solid image was free of any gloss unevenness, and was excellent in image quality.

Rank C: The solid image had some degree of gloss unevenness.

Image quality evaluation was not performed.

Examples 2 and 3

Fixing belts were each produced and evaluated in the same manner as in Example 1 except that the amount of the magnesium oxide serving as the heat conductive filler A was changed to 40 vol % or 43 vol %.

Examples 4 to 6

Fixing belts were each produced and evaluated in the same manner as in Example 1 except that the blending ratios of the heat conductive filler A and the heat conductive filler B were changed as shown in Table 1.

Example 7

A fixing belt was produced and evaluated in the same manner as in Example 1 except that 37 vol % of alumina (product name: AO-509, manufactured by Admatechs Company Limited, average particle diameter: 10 μm) was blended as the heat conductive filler A, and 3 vol % of alumina (product name: AO-502, manufactured by Admatechs Company Limited, average particle diameter: 0.7 μm) was blended as the heat conductive filler B.

Example 8

A fixing belt was produced and evaluated in the same manner as in Example 1 except that 37 vol % of zinc oxide (product name: LPZINC-11, manufactured by Sakai Chemical Industry Co., Ltd., average particle diameter: 11 μm) was blended as the heat conductive filler A, and 3 vol % of zinc oxide (product name: LPZINC-2, manufactured by Sakai Chemical Industry Co., Ltd., average particle diameter: 2 μm) was blended as the heat conductive filler B.

Example 9

A fixing belt was produced and evaluated in the same manner as in Example 1 except that 40 vol % of metallic silicon (product name: M-Si #600, manufactured by Kinsei Matec Co., Ltd., average particle diameter: 10 μm) was blended as the heat conductive filler A, and the heat conductive filler B was not blended.

Example 10

A fixing belt was produced and evaluated in the same manner as in Example 1 except that 40 vol % of silicon carbide (product name: SSC-A15, manufactured by Shinano Electric Refining Co., Ltd., average particle diameter: 11 μm) was blended as the heat conductive filler A, and the heat conductive filler B was not blended.

Example 11

A fixing belt was produced and evaluated in the same manner as in Example 1 except that 40 vol % of boron nitride (product name: SGPS, manufactured by Denka Company Limited, average particle diameter: 12 μm) was blended as the heat conductive filler A, and the heat conductive filler B was not blended.

Example 12

A fixing belt was produced and evaluated in the same manner as in Example 1 except that two kinds of heat conductive filler A, i.e. 4 vol % of metallic silicon (product name: M-Si #600, manufactured by KINSEI MATEC CO., LTD, average particle diameter:10 μm) and 36 vol % of magnesium oxide (product name: SL-WR, manufactured by Konoshima Chemical Co., Ltd., average particle diameter: 10 μm) were employed.

Comparative Example 1

A fixing belt was produced and evaluated in the same manner as in Example 1 except that the electric field application was not performed.

Comparative Example 2

A fixing belt was produced and evaluated in the same manner as in Example 1 except that 40 vol % of a product obtained by sieving the magnesium oxide used in Example 1 to remove particles each having a particle diameter of 4 μm or less was blended as the heat conductive filler A, and the heat conductive filler B was not blended.

Comparative Example 3

A fixing belt was produced and evaluated in the same manner as in Example 1 except that 25 vol % of the magnesium oxide serving as the heat conductive filler A, and 15 vol % of the magnesium oxide serving as the heat conductive filler B were blended

TABLE 1-1

| | | Heat conductive filler | | | Electric | Sectional image analysis of fillers | | | | | |
|---|---|---|---|---|---|---|---|---|---|---|---|
| | | Kind of filler | A vol % | B vol % | Field Application | Average area ratio of large-particle diameter fillers % | Average area ratio of small-particle diameter fillers % | Total % | Array degree of large-particle diameter fillers $f_L$ | Array degree of small-particle diameter fillers $f_S$ | Array angle of small-particle diameter fillers $\Phi_S$ (°) |
| Examples | 1 | MgO | 37 | 3 | applied | 25 | 15 | 40 | 0.11 | 0.25 | 93 |
| | 2 | MgO | 40 | 3 | applied | 28 | 15 | 43 | 0.13 | 0.22 | 91 |
| | 3 | MgO | 43 | 3 | applied | 30 | 16 | 46 | 0.09 | 0.21 | 86 |
| | 4 | MgO | 46 | 0 | applied | 32 | 14 | 46 | 0.11 | 0.21 | 87 |
| | 5 | MgO | 29 | 1 | applied | 20 | 10 | 30 | 0.06 | 0.48 | 91 |
| | 6 | MgO | 57 | 3 | applied | 40 | 20 | 60 | 0.08 | 0.20 | 117 |
| | 7 | $Al_2O_3$ | 37 | 3 | applied | 29 | 11 | 40 | 0.12 | 0.22 | 78 |
| | 8 | ZnO | 37 | 3 | applied | 27 | 13 | 40 | 0.12 | 0.23 | 99 |
| | 9 | Si | 40 | 0 | applied | 30 | 10 | 40 | 0.15 | 0.22 | 103 |
| | 10 | SiC | 40 | 0 | applied | 29 | 11 | 40 | 0.14 | 0.21 | 84 |
| | 11 | BN | 40 | 0 | applied | 30 | 10 | 40 | 0.10 | 0.21 | 71 |
| | 12 | Si | 4 | 3 | applied | 27 | 16 | 43 | 0.13 | 0.23 | 95 |
| | | MgO | 36 | | | | | | | | |
| Comparative Example | 1 | MgO | 37 | 3 | not applied | 25 | 15 | 40 | 0.14 | 0.13 | 22 |
| | 2 | MgO | 40* | 0 | applied | 38 | 2 | 40 | 0.12 | 0.06 | 69 |
| | 3 | MgO | 25 | 15 | applied | 18 | 22 | 40 | 0.16 | 0.07 | 29 |

*Small-particle diameter particles are removed

TABLE 1-2

| | | Elastic layer physical property | | Heating belt evaluation | |
|---|---|---|---|---|---|
| | | Thermal conductivity in thickness direction W/(m · K) | Tensile modulus MPa | Fixability evaluation rank | Image quality evaluation rank |
| Examples | 1 | 1.40 | 0.41 | B | A |
| | 2 | 1.53 | 0.49 | A | A |
| | 3 | 1.60 | 0.52 | A | A |
| | 4 | 1.44 | 0.80 | B | B |
| | 5 | 1.40 | 0.22 | B | A |
| | 6 | 1.99 | 1.27 | A | C |
| | 7 | 1.34 | 0.45 | B | A |
| | 8 | 1.36 | 0.43 | B | A |
| | 9 | 1.38 | 0.50 | B | A |
| | 10 | 1.35 | 0.49 | B | A |
| | 11 | 1.33 | 0.51 | B | A |
| | 12 | 1.51 | 0.54 | A | A |
| Comparative Example | 1 | 1.05 | 0.35 | C | — |
| | 2 | 1.12 | 0.29 | C | — |
| | 3 | 1.19 | 0.36 | C | — |

As can be seen from the results of Table 1, when Example 1 and Comparative Example 1 are compared to each other, in Comparative Example 1 in which no electric field is applied, the large-particle diameter fillers each having a particle diameter of 5 μm or more and the small-particle diameter fillers each having a particle diameter of less than 5 μm are not arrayed in the thickness direction of the elastic layer (the average array degrees $f_L$ and $f_S$ are 0.15 or less). Meanwhile, in Example 1, it is found that the small-particle diameter fillers are arrayed in the thickness direction (the average array degree $f_S$ is 0.20 or more, and the average array angle $\Phi_S$ is 60° or more and 120° or less), and hence the thermal conductivity in the thickness direction is improved. In addition, when Examples 1 to 11, and Comparative Examples 2 and 3 are compared to each other, in the case where the average area ratio of the large-particle diameter fillers is 20% or more and 40% or less, and the average area ratio of the small-particle diameter fillers is 10% or more and 20% or less, the small-particle diameter fillers are arrayed in the thickness direction, and hence the thermal conductivity in the thickness direction is improved. It is found that, as a result of the foregoing, the fixing belts according to Examples 1 to 11 each have satisfactory fixability. Specifically, in each of all Examples, the thermal conductivity in the thickness direction is 1.30 W/(m·K) or more, and hence the fixability is satisfactory; in particular, in Example in which the thermal conductivity in the thickness direction is more than 1.50 W/(m·K), the fixability is more satisfactory.

In addition, the volume blending ratio (average area ratio in the images) of all the fillers is preferably 30% or more and 50% or less. When the volume blending ratio of all the fillers falls within the range, the tensile modulus is as low as 0.20 MPa or more and 1.20 MPa or less (1.20 MPa corresponds to about 60° in terms of Asker C hardness (JIS K7312)), and hence the hardness of the elastic layer is low. As a result, the fixing belt follows the irregularities of the fibers of paper serving as a recording material in a fixing nip portion, and hence the softening and melting unevenness of toner hardly occur. Thus, a high-quality image is obtained.

As shown in the results of Examples 1 to 11, an elastic layer having a high thermal conductivity in its thickness direction and having a low hardness can be formed by appropriately combining the average area ratios, average array degrees $f_L$ and $f_S$, and average array angle $\Phi_S$ of the large-particle diameter fillers and the small-particle diameter fillers in predetermined ranges. In addition, a construction further improved in fixability or a construction further improved in image quality may be selected. Further, like Example 2 or 3, a fixing member in which both fixability and image quality show excellent characteristics may be produced.

In Comparative Example 2, the average area ratio of the small-particle diameter fillers is as small as 2%, and hence the average array degree $f_S$ of the small-particle diameter fillers is as small as 0.06, that is, the small-particle diameter fillers are not arrayed in the thickness direction. Accordingly, the thermal conductivity in the thickness direction is also small. In addition, in Comparative Example 3, the ratios of the fillers to be blended are changed to reduce the average area ratio of the large-particle diameter fillers and to increase the average area ratio of the small-particle diameter fillers. However, the average area ratio of the large-particle diameter fillers is less than 20%, and hence the average array degree $f_S$ of the small-particle diameter fillers is 0.07, that is, the small-particle diameter fillers are not arrayed in the thickness direction. Accordingly, the thermal conductivity is not very high.

The foregoing suggests that, when the large-particle diameter fillers form a local electric field and hence the small-particle diameter fillers present between the large-particle diameter fillers are arrayed, the thermal conductivity is improved. In other words, a possible reason for the foregoing is as described below. The ratio of the large-particle diameter fillers is relatively reduced, and hence a distance between the large-particle diameter fillers increases and the local electric field reduces. Accordingly, the array of the small-particle diameter fillers does not occur. Meanwhile, also when the blending ratio of the small-particle diameter fillers is excessively small, the small-particle diameter fillers may be hardly arrayed.

In Examples and Comparative Examples above, the fixing belts have been described, but it can be easily understood that a similar tendency is observed in the case of a heating roller.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-109671, filed Jun. 7, 2018, which is hereby incorporated by reference herein in its entirety.

What is claimed is:

1. A fixing belt having an endless belt shape of an electrophotographic image forming apparatus comprising:

a substrate; and an elastic layer on the substrate, the elastic layer containing a rubber and fillers dispersed in the rubber, wherein:

assuming that five binarized images each of which has a size of 150 μm ×100 μm on any positions of a first cross-section in a plane in a thickness-peripheral direction of the elastic layer, and five binarized images each of which has a size of 150 μm×100 μm on any positions of a first cross-section in a plane in a thickness-axial direction of the elastic layer are obtained, in each of the binarized images, the fillers are represented as white, and the rubber is represented as black, among the fillers in the binarized images, fillers having a circle-equivalent diameter of 5 μm or more are defined as large-particle diameter fillers, and fillers having a circle-equivalent diameter of less than 5 μm is defined as small-particle diameter fillers, and assuming that area ratios (%) of which total areas of the large-particle diameter fillers with respect to respective binarized images' areas are calculated to obtain an area ratio of the large-particle diameter fillers for each of the binarized images, and area ratios (%) of which total areas of the small-particle diameter fillers with respect to the respective binarized images' areas are calculated to obtain an area ratio of the small-particle diameter fillers for each of the binarized images, an average value of the area ratios of the large-particle diameter fillers is 20% to 40%, and the large-particle diameter fillers have an average array degree $f_L$ of 0.00 to 0.15, an average value of the area ratios of the small-particle diameter fillers is 10% to 20%, the small-particle diameter fillers have an average array degree $f_S$ of 0.20 to 0.50, and the small-particle diameter fillers have an average array angle $\Phi_S$ of 60° to 120°.

2. The fixing belt according to claim 1, wherein a sum of the average value of the area ratios of the large-particle diameter fillers, and the average value of the area ratios of the small-particle diameter fillers, is 30% to 60%.

3. The fixing belt according to claim 1, wherein the elastic layer has a tensile modulus of 0.20 MPa to 1.20 MPa.

4. The fixing belt according to claim 1, wherein the elastic layer has a thermal conductivity in a thickness direction of 1.30 W/(m·K) or more.

5. The fixing belt according to claim 1, wherein the substrate contains at least one selected from the group consisting of nickel, copper, iron, and aluminum.

6. The fixing belt according to claim 1, further comprising a surface layer on the elastic layer.

7. A heat fixing device comprising:

a heating member having an endless belt shape; and a pressurizing member arranged to face the heating member, wherein the heating member includes a substrate and an elastic layer on the substrate, the elastic layer containing a rubber and fillers dispersed in the rubber, wherein:

assuming that five binarized images each of which has a size of 150 μm ×100 μm on any positions of a first cross-section in a plane in a thickness-peripheral direction of the elastic layer, and five binarized images each of which has a size of 150 μm×100 μm on any positions of a first cross-section in a plane in a thickness-axial direction of the elastic layer are obtained, in each of the binarized images, the fillers are represented as white, and the rubber is represented as black, among the fillers in the binarized images, fillers having a circle-equivalent diameter of 5 μm or more are defined as large-particle diameter fillers, and fillers having a circle-equivalent diameter of less than 5 μm is defined as small-particle diameter fillers, and assuming that area ratios (%) of which total areas of the large-particle diameter fillers with respect to respective binarized images' areas are calculated to obtain an area ratio of the large-particle diameter fillers for each of the binarized images, and area ratios (%) of which total areas of the small-particle diameter fillers with respect to the respective binarized images' areas are calculated to obtain an area ratio of the small-particle diameter fillers for each of the binarized images, an average value of the area ratios of the large-particle diameter fillers is 20% to 40%, and the large-particle diameter fillers have an average array degree $f_L$ of 0.00 to 0.15, an average value of the area ratios of the small-particle diameter fillers is 10% to 20%, the small-particle diameter fillers have an average array degree $f_S$ of 0.20 to 0.50, and the small-particle diameter fillers have an average array angle $\Phi_S$ of 60° to 120°.

8. The heat fixing device according to claim 7, further comprising a heating unit configured to heat the substrate.

9. The heat fixing device according to claim 8, wherein the heating unit comprises an induction heating unit.

10. The heat fixing device according to claim 8, wherein the heating unit comprises a heater configured to heat the substrate.

11. The heat fixing device according to claim 10, wherein the heater is arranged so as to be in contact with an inner peripheral surface of the heating member.

* * * * *